US010287800B2

(12) United States Patent
Dagnino

(10) Patent No.: US 10,287,800 B2
(45) Date of Patent: May 14, 2019

(54) LOCK

(71) Applicant: Federico Dagnino, Monte Carlo (MC)

(72) Inventor: Federico Dagnino, Monte Carlo (MC)

( * ) Notice: Subject to any disclaimer, the term of this patent is extended or adjusted under 35 U.S.C. 154(b) by 218 days.

(21) Appl. No.: 15/314,206

(22) PCT Filed: May 26, 2014

(86) PCT No.: PCT/IT2014/000144

§ 371 (c)(1),
(2) Date: Nov. 28, 2016

(87) PCT Pub. No.: WO2015/181838

PCT Pub. Date: Dec. 3, 2015

(65) Prior Publication Data

US 2017/0204634 A1 Jul. 20, 2017

(51) Int. Cl.

| | |
|---|---|
| ***E05B 27/00*** | (2006.01) |
| ***E05B 19/08*** | (2006.01) |
| ***E05B 19/00*** | (2006.01) |
| ***E05B 19/18*** | (2006.01) |

(52) U.S. Cl.

CPC ..... *E05B 27/0046* (2013.01); *E05B 19/0023* (2013.01); *E05B 19/0047* (2013.01); *E05B 19/18* (2013.01); *E05B 27/001* (2013.01); *E05B 27/0017* (2013.01); *E05B 27/0032* (2013.01);

(Continued)

(58) Field of Classification Search

CPC ..... E05B 27/0046; E05B 27/0057; E05B 27/001; E05B 27/0053; E05B 19/0023; E05B 19/0035; E05B 27/0039; E05B 27/0032; E05B 19/18; E05B 19/0047; E05B 27/08; E05B 27/083; E05B 27/0007; E05B 27/0071; E05B 27/0075

USPC ..... 70/360, 361, 358, 419, 493, 379 R, 70/379 A, 380, 373, 375, 491, 496, 403, 70/404, 411, 409

See application file for complete search history.

(56) References Cited

U.S. PATENT DOCUMENTS 1,892,419 A * 12/1932 Best ..... E05B 27/0007 70/375
2,431,894 A 12/1947 Spain
3,987,654 A 10/1976 Iaccino et al.

(Continued)

FOREIGN PATENT DOCUMENTS

DE 44 01 833 A1 7/1995
WO WO-96/38643 A1 12/1996

*Primary Examiner* — Lloyd A Gall
(74) *Attorney, Agent, or Firm* — Blank Rome LLP

(57) ABSTRACT

A lock comprises: a body with a housing comprising a first and a second portion mutually adjacent along an longitudinal development direction corresponding to an insertion direction of a key; a first rotor with a further housing, rotationally housed within the first portion of the housing of the body; a second rotor comprising a first portion rotationally housed within the second portion of the housing of the body; a second portion rotationally housed within the further housing of the first rotor. The second rotor, inserting the key, translates along the longitudinal development direction of the body with respect to the first rotor and, by a first rotation portion of the key, rotates with respect to the first rotor, passing from disengaging to engaging the first rotor, wherein the first rotor and the second rotor, by a second portion of rotation of the key, integrally translate to actuate the lock.

23 Claims, 15 Drawing Sheets

(52) U.S. Cl.
CPC ..... *E05B 27/0039* (2013.01); *E05B 27/0053* (2013.01); *E05B 27/0057* (2013.01)

(56) References Cited

U.S. PATENT DOCUMENTS 4,196,605 A 4/1980 Garza
4,601,184 A * 7/1986 Doinel ..... E05B 17/186 70/360
5,148,690 A * 9/1992 Wang ..... E05B 27/00 70/358
5,475,997 A * 12/1995 Chung ..... E05B 27/001 70/358
6,758,073 B2 * 7/2004 Yu ..... E05B 27/001 70/358
7,966,852 B1 * 6/2011 Huang ..... E05B 17/04 70/369
8,899,083 B2 * 12/2014 Dagnino ..... E05B 29/0026 70/358
9,038,427 B2 * 5/2015 Shen ..... E05B 27/0075 70/358

* cited by examiner

LOCK

BACKGROUND OF THE INVENTION

The present invention relates to a lock, particularly a mechanical lock. Mechanical locks that can be applied to doors, windows, shutters, and the like are known.

A mechanical lock of a known type has a fixed part suitable to house the lock mechanisms, and a movable part provided with a keyhole for the insertion of the key. The movable part, actuating the opening/closing mechanism of the lock, is typically locked by pins that are removed upon the insertion of the right key, thus allowing the movable part rotation.

For example, in a drum lock of a known type, the fixed part, or stator (starting from the inner surface) and the movable part or rotor (starting from the outer surface) are provided with respective radial cavities that are mutually alignable so as to define a seat within which they can radially translate a pin and a counter-pin. A spring is located between each pin and the stator, suitable to push the pin and the counter-pin in a radial direction from the outside inwardly. In the case that the key is not inserted, each pin, by virtue of the action of the respective spring, is within the respective radial cavity in such a position as to inhibit the rotor rotation within the stator. In the case that the key is inserted, the key profile allows moving within the respective radial cavity, from the inside outwardly, each pin and counter-pin so that the lower part of the pin and the upper part of the counter-pin are aligned with the outer edge of the rotor. In such a case, by rotating the key, the rotor is in turn able to rotate within the stator and actuate the lock opening/closing mechanism.

In terms of security, the mechanical lock of the prior art described above can be subjected to several breaking open operations.

For example, it is possible to destruct the rotor containing the counter-pins. Following the forced removal of the pins from the stator, the rotor can freely rotate with respect to the stator and actuate the lock opening/closing mechanism.

According to another breaking open operation, it is possible to apply a torsional tension onto the rotor, so as to cause the possible forced inclination of pins and counter-pins, due to the mechanical tolerances that are present between rotor and pins/counter-pins and between pins/counter-pins and stator. Subsequently, by lifting the counter-pins and the pins one by one, each of them moves outside the respective radial cavity and it is not able to come back to the initial position, since the rotor, which is subjected to the torsional tension, is rotated with respect to the stator. Once all the counter-pins and the pins are made to fall off of the rotor and the stator, the same rotor may freely rotate within the stator by actuating the lock opening/closing mechanism.

The latter breaking open operation can be successfully applied to other mechanical locks. In fact, it is sufficient to create a torsional tension between the fixed part (stator) and the movable part (rotor) to exploit those construction mechanical tolerances of the lock that are present also after the assembling of the same lock, in order to make the elements (pins, counter-pins, optionally, springs) used for actuating the lock opening/closing mechanism fall off from the radial cavities.

Furthermore, in the case of a hierarchic key system, i.e., multiple user keys, each of which being suitable to open only one lock, and a master key or passepartout suitable to open all the locks, the mechanical lock of the prior art described above may easily allow a burglar, who has a user key available, retrieving even the master key code.

In fact, a user key being available, it is possible to file a master key until reproducing all the components of the user key code, with the exception of one. The part of the master key that has not been filed is progressively filed by trial and error until obtaining the code component that allows opening with a filing different from the original one. The identified code component is the code component of the master key for the position in which the code component is located. By repeating such operation for the other positions of the code components, it is possible to retrieve the entire code of the master key.

SUMMARY OF THE INVENTION

The object of the present invention is to devise and provide a mechanical lock that allows at least partially obviating the drawbacks set forth above with reference to the prior art.

Such an object is achieved by a mechanical lock, comprising:

a body suitable to define a housing having a longitudinal development direction along a insertion direction of a key, the housing comprising a first portion and a second portion mutually adjacent along the longitudinal development direction of the body;

a first rotor suitable to be rotationally housed within the first portion of the housing of such body about the longitudinal development direction of the body, the first rotor being suitable to define a further housing;

a second rotor comprising a first portion suitable to be rotationally housed within the second portion of the housing of the body about the longitudinal development direction of such body, the second rotor comprising a second portion suitable to be rotationally housed within the further housing defined by the first rotor about the longitudinal development direction of such body, the second rotor, by the insertion of the key, being suitable to translate along the longitudinal development direction of the body with respect to the first rotor, the second rotor, by a first rotation portion of the key, being suitable to rotate about the longitudinal development direction of the body with respect to the first rotor, to pass from a disengagement position to an engagement position with the first rotor, in said engagement position, the first rotor and the second rotor, by a second portion of rotation of the key, being suitable to integrally translate along the longitudinal development direction of the body to reach an actuating position of the lock.

It is the object of the present invention also a lock assembly comprising the mechanical lock in accordance with the present invention and an actuation key of said lock.

BRIEF DESCRIPTION OF THE DRAWINGS

Further characteristics and advantages of the mechanical lock according to the invention will be apparent from the description set forth below of preferred embodiment examples, given by way of illustrative, non-limiting example, with reference to the annexed figures, in which.

DETAILED DESCRIPTION OF THE PREFERRED EMBODIMENTS

With reference to the above-mentioned figures, a mechanical lock is now described, generally indicated by the reference number 1, in accordance with an embodiment of the present invention.

It is pointed out that equal or the like elements and components are indicated in the Figures by the same numeral references.

It shall be noticed that the above-mentioned mechanical lock 1, herein below also simply referred to as a lock, can be applied, particularly, to doors, shutters, or the like, both for interior or exterior settings, of houses, pieces of furniture, vehicles, crafts, and so on, but also to portable closing devices, such as padlocks.

Figure 2:
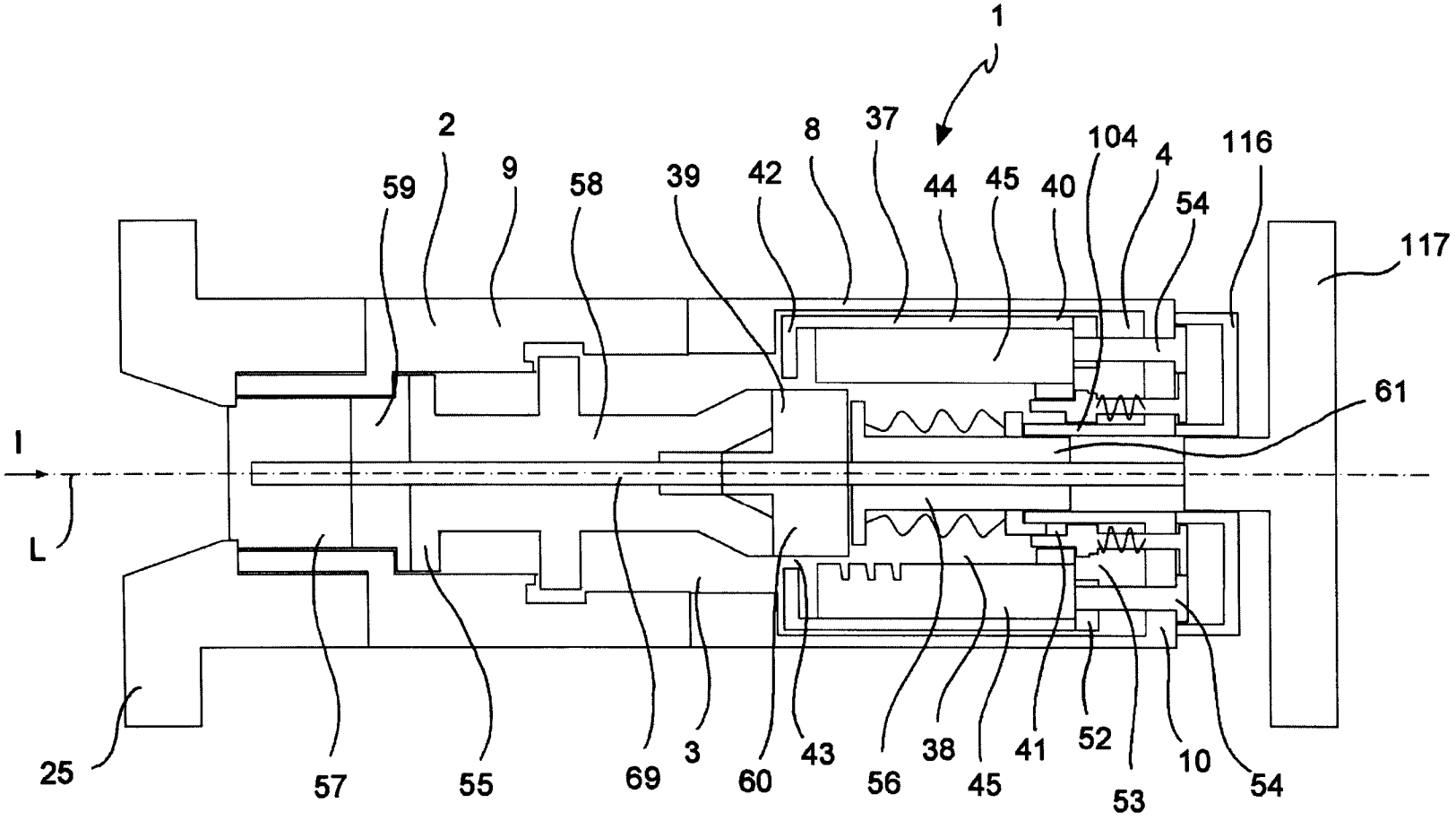
FIG. 2 schematically illustrates a view in a further side section of the mechanical lock of FIG. 1.
Figure 3:
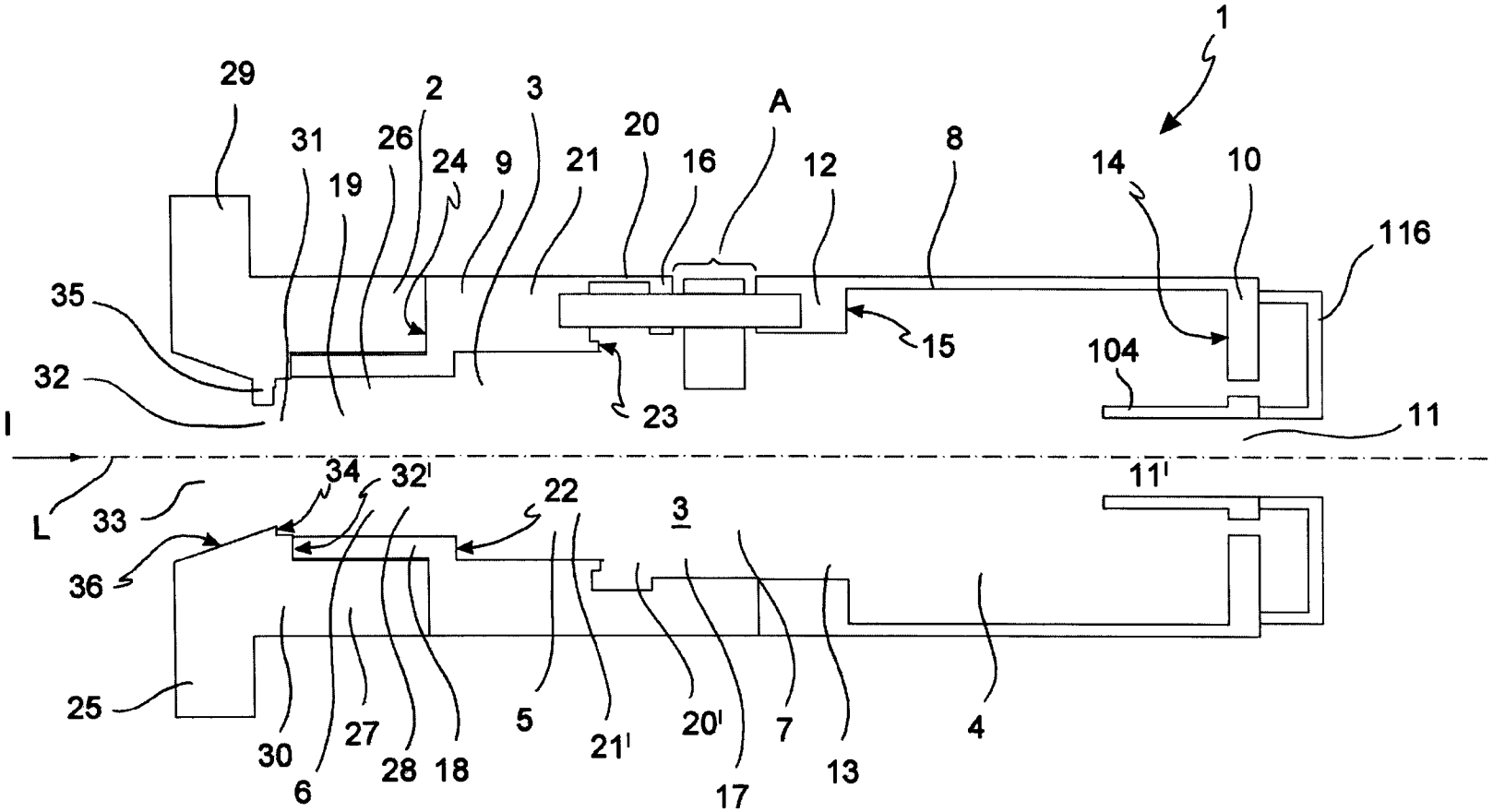
FIG. 3 schematically illustrates a side view of a component of the mechanical lock of FIG. 1.
Figure 4:
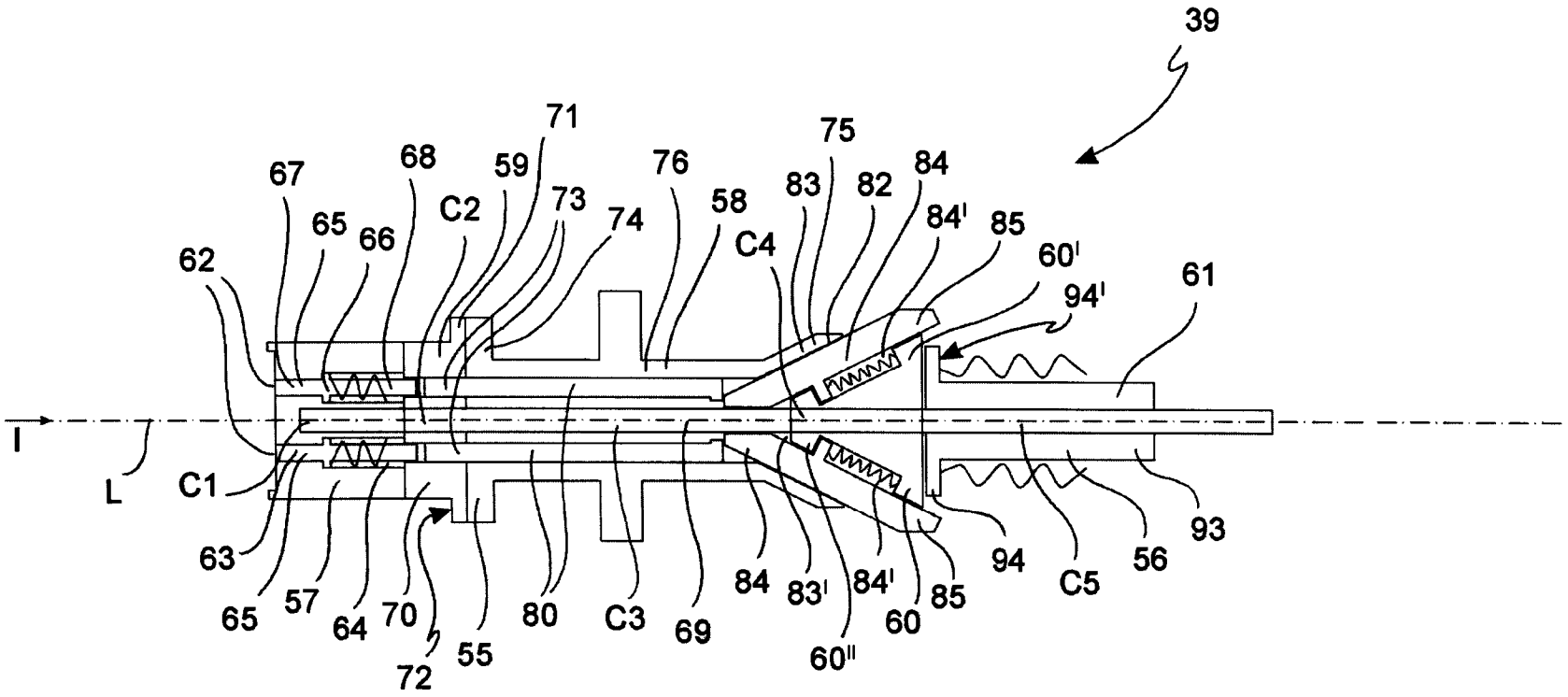
FIG. 4 schematically illustrates a view in side section of a further component of the mechanical lock of FIG. 1.
Figure 5:
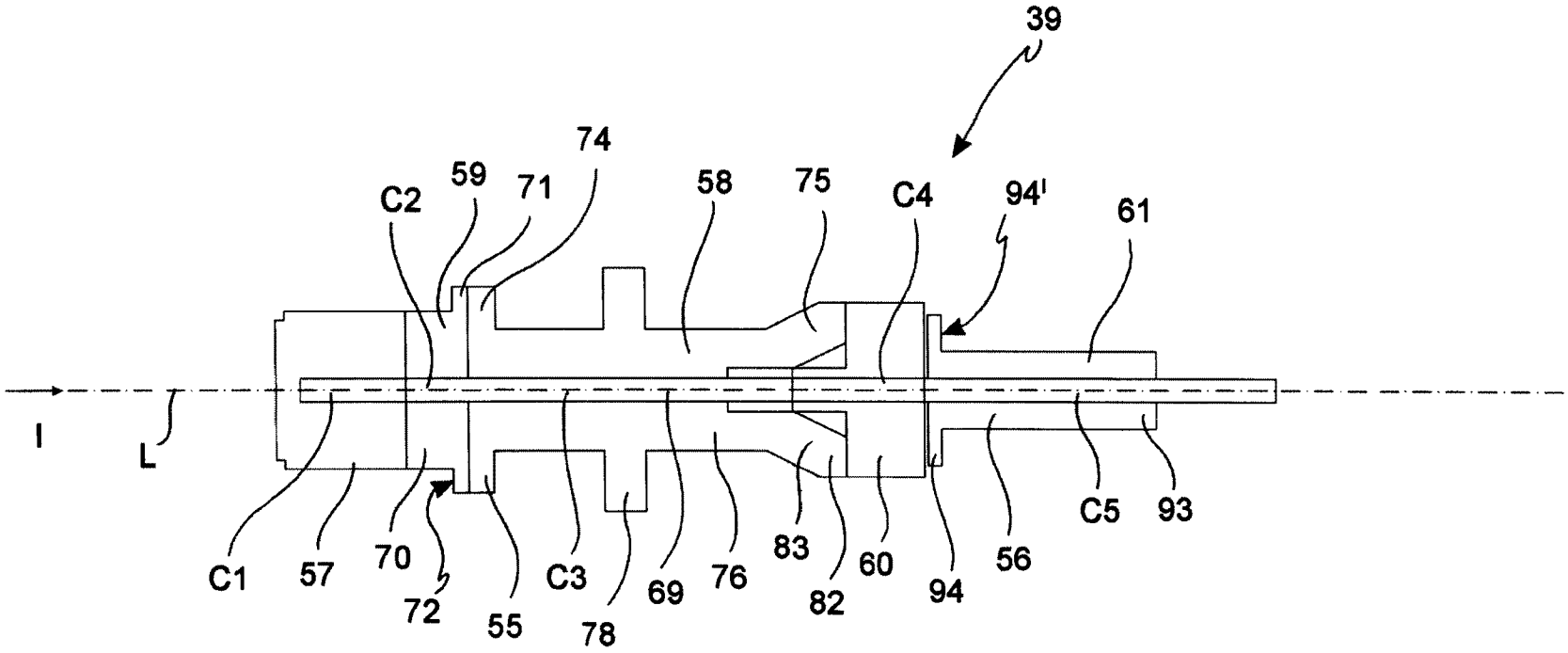
FIG. 5 schematically illustrates a view in a further side section of the further component of FIG. 4.
Figure 6:
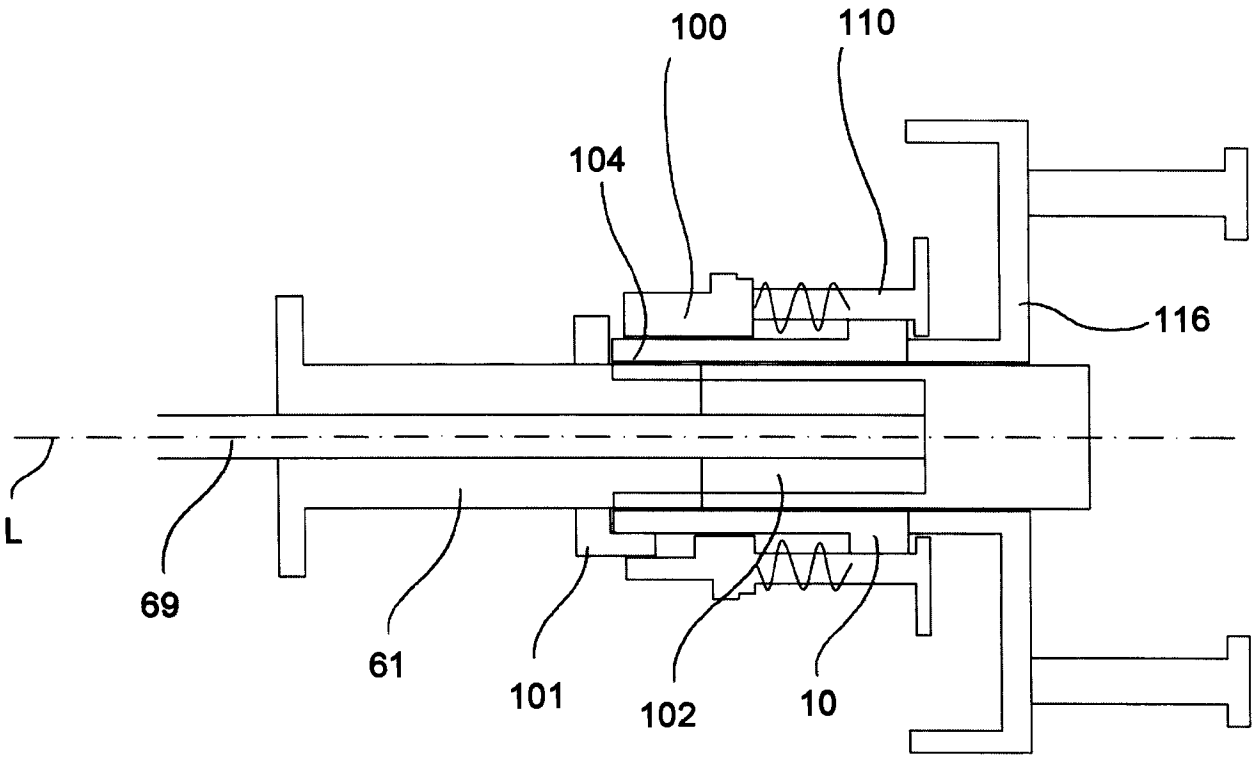
FIG. 6 schematically illustrates a side sectional view of further components of the lock of FIG. 1.
Figure 7:
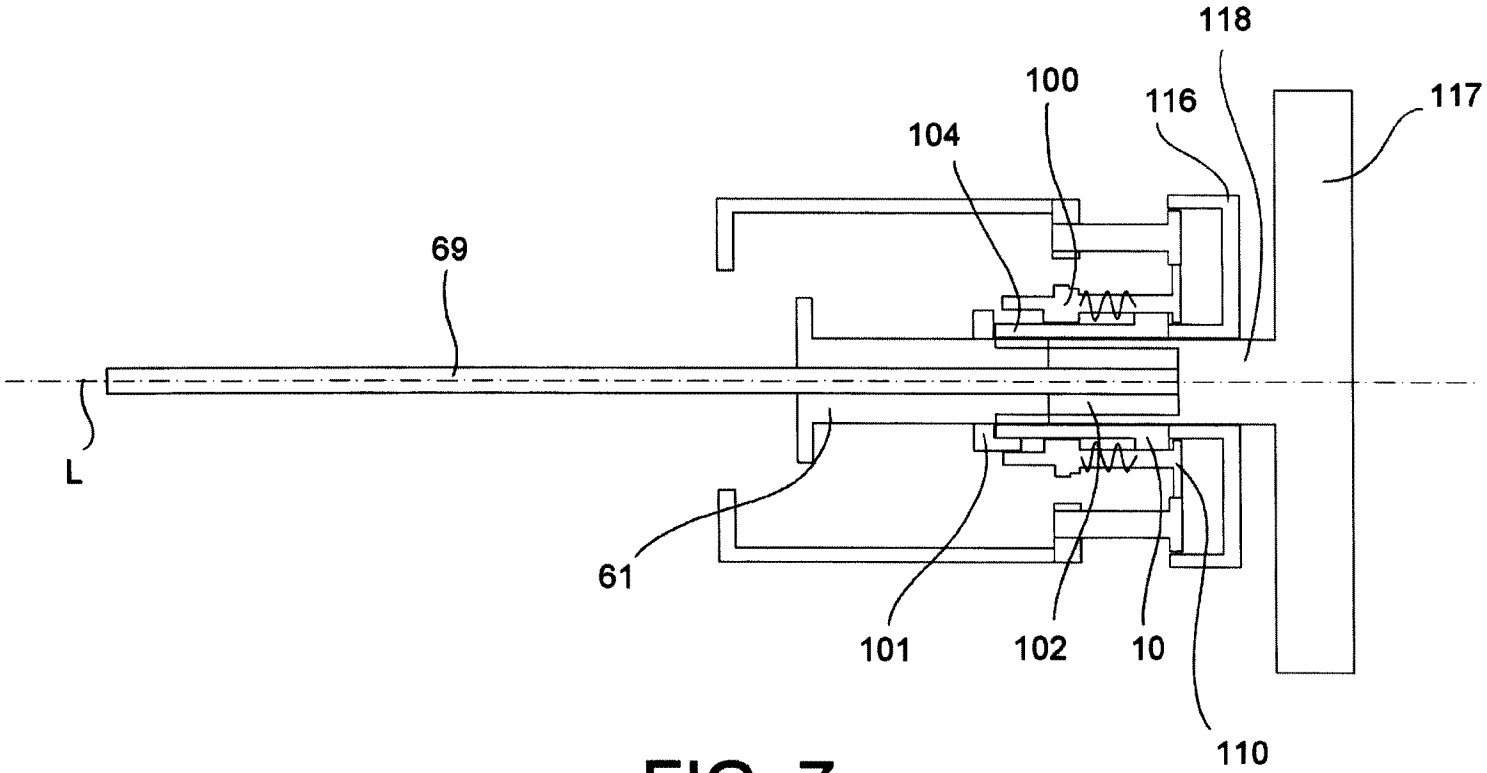
FIG. 7 schematically illustrates a side sectional view of further components of the lock of FIG. 1.

With particular reference to FIG. 3, the lock 1 comprises a body 2 suitable to define a housing 3 having a longitudinal development direction L along a insertion direction I of a key. For the sake of illustration simplicity, the key is not shown in the FIGS. 1, 2 and 3.

The housing 3 of such body 2, transversally to the longitudinal development direction L, preferably has a cylindrical cross-section.

Particularly, such housing 3 comprises a first portion 4 and a second portion 5 mutually adjacent along the longitudinal development direction L of the body 2.

The second portion 5 comprises in turn a peripheral portion 6 and an inner portion 7. The inner portion 7 of the second portion 5 is arranged between the peripheral portion 6 of the second portion 5 and the first portion 4 of the housing 3.

The peripheral portion 6, the inner portion 7 (therefore the second portion 5) and the first portion 4 of the housing 3 preferably have a cylindrical cross-section with respect to the transversal of the longitudinal development direction L of the body 2.

In more detail, transversally to the longitudinal development direction L of the body 2, the central portion 7 of the second portion 5 preferably has a cylindrical cross-section with a dimension larger than the dimension of the cylindrical cross-section of the peripheral portion 6 of the second portion 5. Furthermore, transversally to the longitudinal development direction L of the body 2, the first portion 4 of the housing 3 preferably has a cylindrical cross-section with a dimension larger than the dimension of the cylindrical cross-section of the inner portion 7 of the second portion 5 of the housing 3.

The body 2 comprises a first portion 8 and a second portion 9 shaped and mutually opposite to define the housing 3.

In more detail, the first portion 8 of the body 2 comprises a first peripheral wall 10 having a preferably cylindrical section in a direction orthogonal to the longitudinal development direction L of the body 2. The first peripheral wall 10 has a respective opening 11 arranged substantially in the center of the first peripheral wall 10. Such opening 11 has a cylindrical cross-section with a dimension lesser than the dimension of the cylindrical cross-section of the first portion 4 of the housing 3.

The first portion 8 of the body 2 further comprises a second peripheral wall 12, opposite the first peripheral wall 10, having a preferably cylindrical section in a direction orthogonal to the longitudinal development direction L of the body 2. The second peripheral wall 12 has a respective opening 13 arranged substantially in the center of the second peripheral wall 12. Such opening 13 has a cylindrical cross-section with a dimension lesser than the dimension of the cylindrical cross-section of the first portion 4 of the housing 3. Such opening 13 has a cylindrical cross-section with a dimension larger than the dimension of the cylindrical cross-section of the opening 11 that is present in the first peripheral wall 10 of the first portion 8 of the body 2.

It shall be noticed that the first portion 8 of the body 2, transversally to the longitudinal development direction L of the body 2, between the first peripheral wall 10 and the second peripheral wall 12, has internally a cylindrical cross-section suitable to define the first portion 4 of the housing 3.

It shall be noticed that the dimension difference between the cylindrical cross-section of the opening 11 present on the first peripheral wall 10 with respect to the cylindrical cross-section of the first portion 8 of the body 2 defines a first circular crown 14 for the abutment of a component (first rotor, described below) that can be housed within the first portion 8 of the body 2. The dimension difference between the cylindrical cross-section of the opening 13 present on the second peripheral wall 12, with respect to the cylindrical cross-section of the first portion 8 body 2, defines a second circular crown 15 for the abutment of a component (first rotor, described below) that can be housed within the first portion 8 of the body 2.

It shall be further noticed that the first portion 8 of the body 2 further comprises an inner wall 104 extending, along the longitudinal development direction L of the body 2, from the first peripheral wall 10 towards the first portion 4 of the housing 3. It shall be noticed that the inner wall 104 defines a respective through opening 11' (FIG. 3) having, transversally to the longitudinal development direction L of the body 2, a cylindrical cross-section with a dimension that is substantially the same as the dimension of the cylindrical cross-section of the opening 11 that is present in the first peripheral wall 10 of the first portion 8 of the body 2.

Furthermore, the body 2 comprises a cover member 116 operatively connected to the first peripheral wall 10 of the first portion 8 of the body 2. Such cover member 116 has substantially in the center a through opening having, transversally to the longitudinal development direction L of the body 2, a cylindrical cross-section with a dimension that is substantially the same as the dimension of the cylindrical cross-section of the opening 11 that is present in the first peripheral wall 10 of the first portion 8 of the body 2.

The second portion 9 of the body 2 comprises a first peripheral wall 16 having a preferably cylindrical section in a direction orthogonal to the longitudinal development direction L of the body 2. The first peripheral wall 16 of the second portion 9 has a respective opening 17 arranged substantially in the center of the first peripheral wall 16.

It shall be noticed that the first peripheral wall 16, at an upper part of the second portion 9 of the body 2, along the longitudinal development direction L of the body 2, has a length such as to define a radial opening A of the housing 3. As it shall be explained below, such radial opening A allows the use of mechanisms housed within the body 2 (partially shown in FIG. 3) with an opening/closing mechanism (per se known), not shown in the figures, actuatable by the lock 1.

In a further embodiment (not shown in the figures), the mechanisms housed within the body 2 (partially shown in FIG. 3) can be provided with a safety pin suitable to abut against a projection obtained on the first rotor 37.

As long as the first rotor 37 is not made to slide along the longitudinal development direction L of the body 2 until disengaging the safety pin from the projection of the first rotor 37, the opening/closing mechanism is not able to rotate freely and allow opening the lock 1. On the contrary, in case that the first rotor 37, sliding along the longitudinal development direction L of the body 2, disengages the safety pin from the projection of the first rotor 37, the opening/closing mechanism is able to freely rotate, thus promoting the opening of the lock.

The fact of requiring also the sliding of the first rotor 37 to allow the actuation of the opening/closing mechanism advantageously introduces a further safety level for the lock 1.

Referring back to the second portion 9 of the body 2, it further comprises a second peripheral wall 18, opposite the first peripheral wall 16, having a preferably cylindrical section in a direction orthogonal to the longitudinal development direction L of the body 2. The second peripheral wall 18 has a respective opening 19 arranged substantially in the center of the second peripheral wall 18.

The second portion 9 of the body 2 further comprises a first inner wall 20 and a second inner wall 21 arranged between the first peripheral wall 16 and the second peripheral wall 18 of the second portion 9 of the body 2. Particularly, the first inner wall 20 is interposed between the first peripheral wall 16 and the second inner wall 21. The first inner wall 20 has a respective opening 20' not aligned with respect to the longitudinal development direction L of the body 2. The second inner wall 21 has a respective opening 21' arranged substantially in the center of the second inner wall 21.

Referring again to the second portion 9 of the body 2, the opening 19 of the second peripheral wall 18 has a cylindrical cross-section with a dimension lesser than the dimension of the cylindrical cross-section of the opening 21' of the second inner wall 21. The opening 21' of the second inner wall 21 is smaller with respect to the dimension of the cylindrical cross-section of the opening of the first peripheral wall 16. The opening 20' of the second inner wall 20 has a dimension of the cylindrical cross-section preferably greater to both the dimension of the cylindrical cross-section of the opening 21' of the first inner wall 21 and the dimension of the cylindrical cross-section of the first peripheral wall 16.

It shall be noticed that the second portion 9 of the body 2, transversally to the longitudinal development direction L of the body 2, at the second peripheral wall 18, has internally a cylindrical cross-section suitable to define the second portion 5 of the housing 3.

Furthermore, it shall be noticed that the second portion 9 of the body 2, transversally to the longitudinal development direction L of the body 2, has multiple cylindrical sections having different dimensions, at the first peripheral wall 16, of the first inner wall 20 and of the second inner wall 21, suitable to define the second portion 5 of the housing 3.

It shall be noticed that the dimension difference between the cylindrical cross-section of the opening 19 present on the second peripheral wall 18 with respect to the cylindrical cross-section of the second inner wall 21 of the second portion 9 of the body 2 defines a third circular crown 22 for the abutment of a portion of a component (second rotor, described below) that can be housed within the second portion 9 of the body 2. The dimension difference between the cylindrical cross-section of the opening 21' present on the first inner wall 21 with respect to the cylindrical cross-section of the first peripheral wall 16 of the second portion 9 of the body 2 defines a fourth circular crown 23 for the abutment of another portion of the component (second rotor, described below) that can be housed within the second portion 9 of the body 2.

It shall be further noticed that the second peripheral wall 18 of the second portion 9 of the body 2 has an outer cylindrical cross-section with a dimension smaller than the dimension of the outer cylindrical cross-section of the second inner wall 21 (and the first inner wall 20). The dimension difference between the outer cylindrical cross-section of the second peripheral wall 18 with respect to the outer cylindrical cross-section of the second inner wall 21 defines a fifth circular crown 24 for the abutment of a further component, described below, of the body 2 of the lock 1.

To this aim, the body 2 further comprises a first end 25 suitable to define a further housing 26 suitable to receive a part of the second portion 9 of the body 2.

In more detail, the first end 25 of the body 2 comprises an inner wall 27, having a preferably cylindrical section in a direction orthogonal to the longitudinal development direction L of the body 2. The inner wall 27 has a respective opening 28 arranged substantially in the center of the inner wall 27. Transversally to the longitudinal development direction L of the body 2, the inner wall 27 defines the further housing 26.

The first end 25 of the body 2 further comprises an outer wall 29 and an intermediate wall 30. The intermediate wall 30 is arranged between the outer wall 29 and the inner wall 27 of the first end 25.

The intermediate wall 30, having a preferably cylindrical section in a direction orthogonal to the longitudinal development direction L of the body 2, has a respective opening 31 arranged substantially in the center of the intermediate wall 30.

The opening 31 of the intermediate wall 30 has a cylindrical cross-section with a dimension lesser than the dimension of the cylindrical cross-section of the opening 28 present in the inner wall 27 of the first end 25 of the body 2.

The dimension difference between the cylindrical cross-section of the opening 28 present on the inner wall 27 with respect to the cylindrical cross-section of the opening 31 of the intermediate wall 30 of the first end 25 of the body 2 defines a sixth circular crown 32' for the abutment of the second peripheral wall 18 of the second portion 9 of the body 2.

Furthermore, the inner wall 27 of the first end 25 is suitable to abut against the fifth abutment circular crown 24 defined externally on the second portion 9 of the body 2.

The outer wall 29 of the first end 25 of the body 2, having preferably a frusto-conical section in a direction orthogonal to the longitudinal development direction L of the body 2, has a first opening 32 facing the intermediate wall 27 and a second opening 33, opposite said first opening 32, facing outwardly of the first end 25.

The first opening 32 of the outer wall 29 has a cylindrical cross-section with a dimension lesser than the dimension of the cylindrical cross-section of the opening 31 present in the inner wall 30 of the first end 25 of the body 2.

The dimension difference between the cylindrical cross-section of the opening 32 present on the outer wall 29 with respect to the cylindrical cross-section of the opening 31 of the intermediate wall 30 of the first end 25 of the body 2 defines a seventh circular crown 34 for the abutment of the component (second rotor, described below) that can be housed within the housing 3 of the body 2.

The first end 25 of the body 2 further comprises a dente 35 defined on the surface 36 of the frusto-conical section preferably at the first opening 32 of the inner wall 29 of the first end 25 of the body 2.

The tooth 35, as it shall be described below, is suitable to slidably engage in a groove obtained on a key usable for actuating the lock 1. Referring now particularly to the FIGS. 1-5 and 10*c*, the lock 1 further comprises a first rotor 37 suitable to be rotationally housed within the first portion 4 of the housing 3 of such body 2 about the longitudinal development direction L of the body 2.

Furthermore, such first rotor 37 is suitable to define a further housing 38 to receive part of a second rotor 39 (as indicated for example in the FIGS. 1-2) rotatable within the first rotor 37 about the longitudinal development direction L of such body 2. Such second rotor 39 shall be described below.

In more detail, the first rotor 37 comprises a first peripheral wall 40 having a respective opening 41 (indicated only in FIG. 2). The first peripheral wall 40 has a preferably cylindrical section in a direction orthogonal to the longitudinal development direction L of the body 2. The opening 41 of the first peripheral wall 40 is arranged substantially in the center of the first peripheral wall 40.

Furthermore, the first rotor 37 comprises a second peripheral wall 42, opposite said first peripheral wall 40, having a respective opening 43. The second peripheral wall 42 has a preferably cylindrical section in a direction orthogonal to the longitudinal development direction L of the body 2. The opening 43 of the second peripheral wall 42 is arranged substantially in the center of the second peripheral wall 42.

Both the opening 41 present on the first peripheral wall 40 and the opening 43 present on the second peripheral wall 42 of the first rotor 37 have a cylindrical cross-section with a dimension lesser than the dimension of the cylindrical cross-section of the first rotor 37. Furthermore, the opening 41 present on the first peripheral wall 40 has a cylindrical cross-section preferably with a dimension lesser than the dimension of the cylindrical cross-section of the opening 43 that is present in the second peripheral wall 42 of the first rotor 37.

The first rotor 37 comprises a side wall 44 extending, transversally to the longitudinal development direction L of the body 2, between the first peripheral wall 40 and the second peripheral wall 42.

The side wall 44 of the first rotor 37 has internally a cylindrical cross-section, in a direction orthogonal to the longitudinal development direction L of the body 2, suitable to define the further housing 38. Furthermore, again in a direction orthogonal to the longitudinal development direction L of the body 2, the side wall 44 of the first rotor 37 has externally a cylindrical cross-section substantially corresponding to the first portion 8 of the housing 3 of the body 2.

Figure 10A:
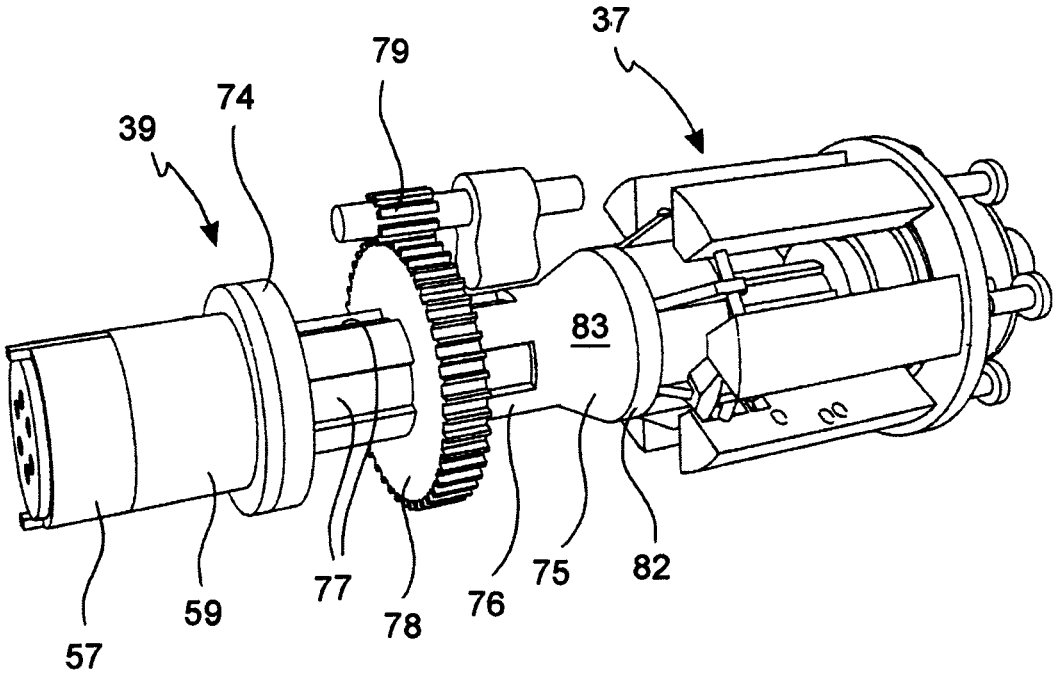
FIGS. 10*a*-10*g* schematically illustrate perspective views of different components or portions of the mechanical lock of FIG. 1.
Figure 10B:
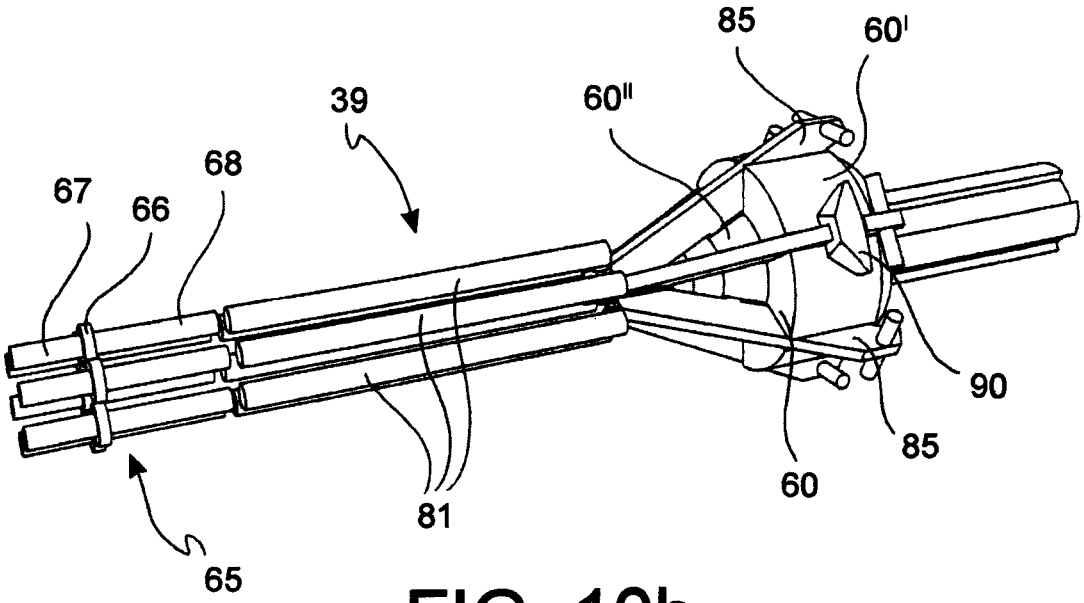
Figure 10C:
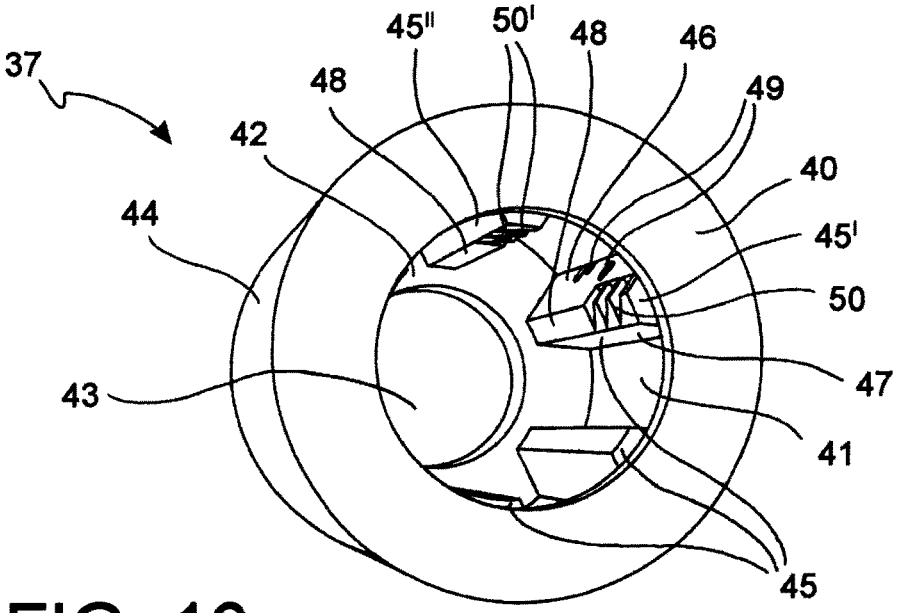

With particular reference to the FIGS. 2 and 10*c*, the first rotor 37 comprises a plurality of ribs 45 distributed on the inner surface (i.e., facing the further housing 38) of the side wall 44 of the first rotor 37.

Each rib of the above-mentioned plurality extends along the longitudinal development direction L of the body 2 preferably throughout the length of the side wall 44 of the first rotor 37.

Furthermore, each rib of the above-mentioned plurality comprises a first radial wall 46 and a second radial wall 47 extending radially with respect to the longitudinal development direction L of the body 2 preferably by a length substantially corresponding to the dimension of the cylindrical cross-section of the second peripheral wall of the first rotor 37.

Each rib of the above-mentioned plurality comprises a connecting wall 48, opposite the inner surface of the side wall 44 of the first rotor 37, between the first radial wall 46 and the second radial wall 47. The connecting wall 48 extends preferably parallel to the longitudinal development direction L of the body 2.

The ribs of said plurality are mutually adjacent so that the first radial wall 46 of each rib faces the second radial wall 47 of the adjacent rib.

The first rotor 37 further comprises a first plurality of holes 49 distributed on the first radial wall 46 of each rib of said plurality of ribs 45.

The first rotor 37 further comprises a second plurality of holes (not visible in the figures) distributed on the second radial wall 47 of each rib of said plurality of ribs 45.

It is pointed out that the first plurality of holes 49 and the second plurality of holes present, respectively, on the first radial wall 46 and the second radial wall 47, in case that the first radial wall 46 and the second radial wall 47 are mutually facing, are preferably distributed so that each hole of the first plurality of holes 49 is aligned with a respective hole of the second plurality of holes, so as to define a pair of aligned holes.

In more detail, it is pointed out that each pair of aligned holes of said first plurality of holes 49 and second plurality of holes, present on the respective first radial wall 46 and the respective second radial wall 47, mutually facing, are preferably distributed in mutually different positions along the longitudinal development direction L of the body 2.

In other words, the position of the holes within the same pair is the same, while the position between pairs of holes is different.

It is pointed out that the different positions of the pairs of first plurality of holes and second plurality of holes define the actuation code of the lock 1.

Again with reference to the first radial wall 46 and the second radial wall 47 of any of the ribs 45, in accordance with an embodiment (not shown in the figures), alternatively or in combination with those described above, on each of said first radial wall 46 and second radial wall 47, a plurality of knurlings can be obtained in relief, each of which having the same or a different distance from the adjacent knurlings and extending along a parallel or different direction with respect to the development direction of the other knurlings.

Referring generally back to the first plurality of holes 49 and the second plurality of holes, it is further pointed out that each hole of the first plurality of holes 49 and the second plurality of holes extends within the respective rib preferably along a direction substantially orthogonal to the respective substantially radial wall on which it is distributed.

In addition, the holes of the first plurality of holes 49 (hence, also the respective holes of the second plurality of holes) are mutually unaligned along the longitudinal development direction L of the body 2.

Each hole of such first plurality of holes 49 (and of such second plurality of holes) represents, as it shall be explained below, an actuation code of an established hierarchic key, in a hierarchic key system, with which it is possible to actuate the lock 1.

In fact, the number of holes of each first plurality of holes (and second plurality of holes), for example, M, corresponds to the number of levels, M, of the hierarchic key system (where M>1).

To this aim, in the embodiment of the figures, each plurality of holes comprises three holes (M=3), i.e., a first hole, a second hole, and a third hole, mutually unaligned along the longitudinal development direction L of the body 2. The first hole represents a first code of a first key, for example, a user key, the second hole represents a second code of a second hierarchic key, for example, a master key, of a higher hierarchic level than that of the first key, the third hole represents a third code of a third key, for example, a general master key, of a higher hierarchic level than that of the second key.

In accordance with other embodiments, as already stated above, each plurality of holes may comprise any number of holes, starting from 1 (M>1).

Referring back to the embodiment illustrated in the FIGS. 2 and 10*c*, the first rotor 37 further comprises a first plurality of notches 50 distributed on the first radial wall 46 of at least one rib 45' of said plurality of ribs 45.

The first rotor 37 further comprises a second plurality of notches 50' distributed on the second radial wall of at least one further rib 45" of said plurality of ribs 45, adjacent to said at least one rib 45'. Each notch of the second plurality of notches 50' is preferably distributed so that each notch of the second plurality of notches 50' is aligned with a notch of the first plurality of notches 50.

It is pointed out that both the first plurality of notches 50 and the second plurality of notches 50' are preferably distributed, along the longitudinal development direction L of the body 2, in a peripheral position, respectively, of the first radial wall 46 and the second radial wall 47, facing the opening 43 of the second peripheral wall 42 of the first rotor 37.

Furthermore, it shall be noticed that the first plurality of notches 50 and the second plurality of notches 50' are distributed preferably on some pairs of mutually facing first radial wall and second radial wall. In the embodiment of the figures, the first plurality of notches 50 and the second plurality of notches 50' are distributed only on three pairs of first radial wall and second radial wall of the ribs of said first plurality of ribs 45.

It shall be noticed that, along the longitudinal development direction L of the body 2, each notch of the first plurality of notches 50 (and of the second plurality of notches 50') is in a respective position corresponding to an established key in a hierarchic key system, with which it is possible to actuate the lock 1.

To this aim, in a completely similar manner to what has been described above with reference to the first plurality of holes and the second plurality of holes distributed on the plurality of ribs 45, the number of notches of each first plurality of notches (and second plurality of notches) corresponds to the number of levels (M) of the hierarchic key system (with M>1).

In the embodiment of the figures, each plurality of notches comprises three notches (M=3), each corresponding to a hierarchic level of the hierarchic key system already described above (for example, first notch: "user key", second notch: "master key", third notch: "general master key").

Figure 1:
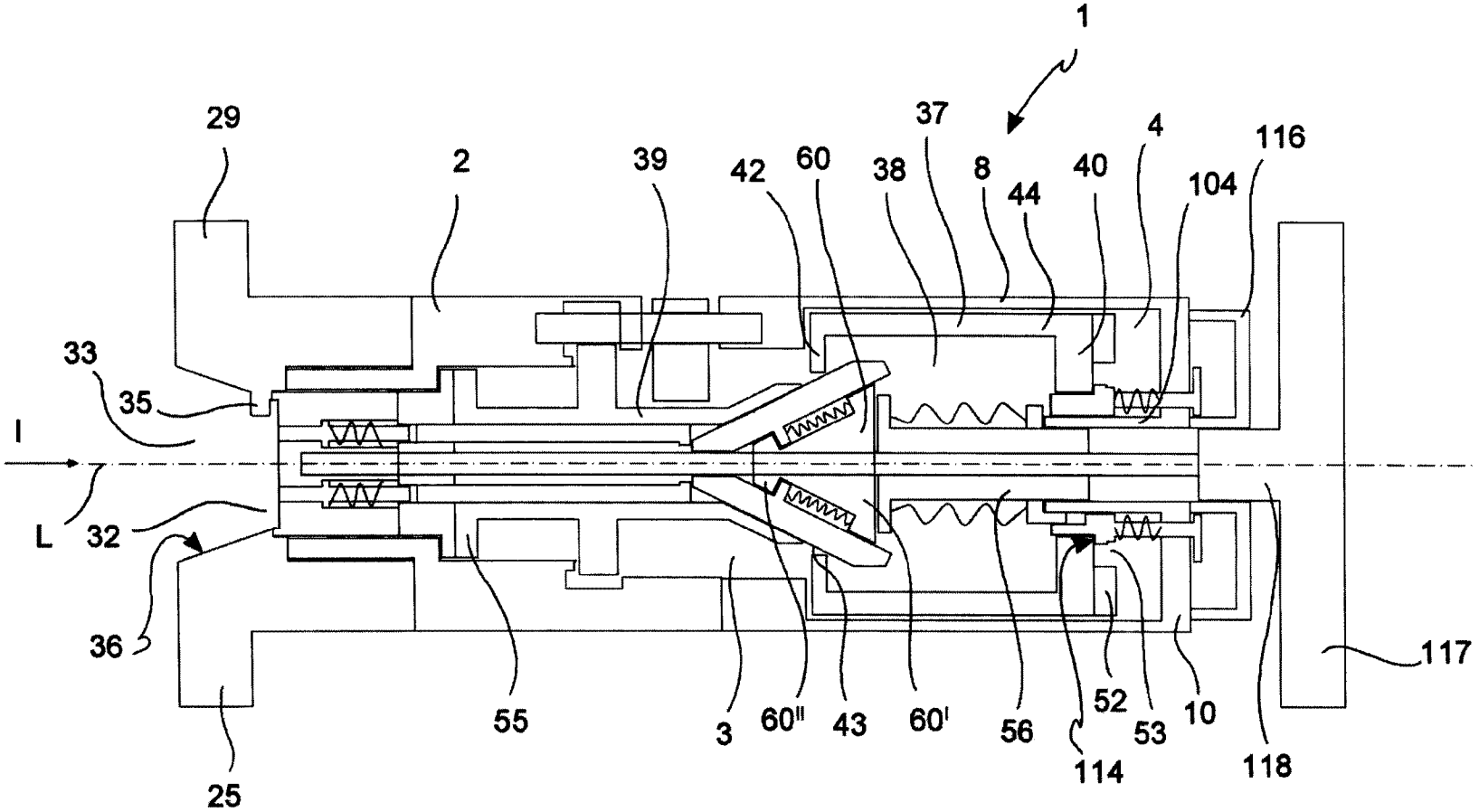
FIG. 1 schematically illustrates a side sectional view of a mechanical lock according to an embodiment of the invention when the key is disconnected.
Figure 10D:
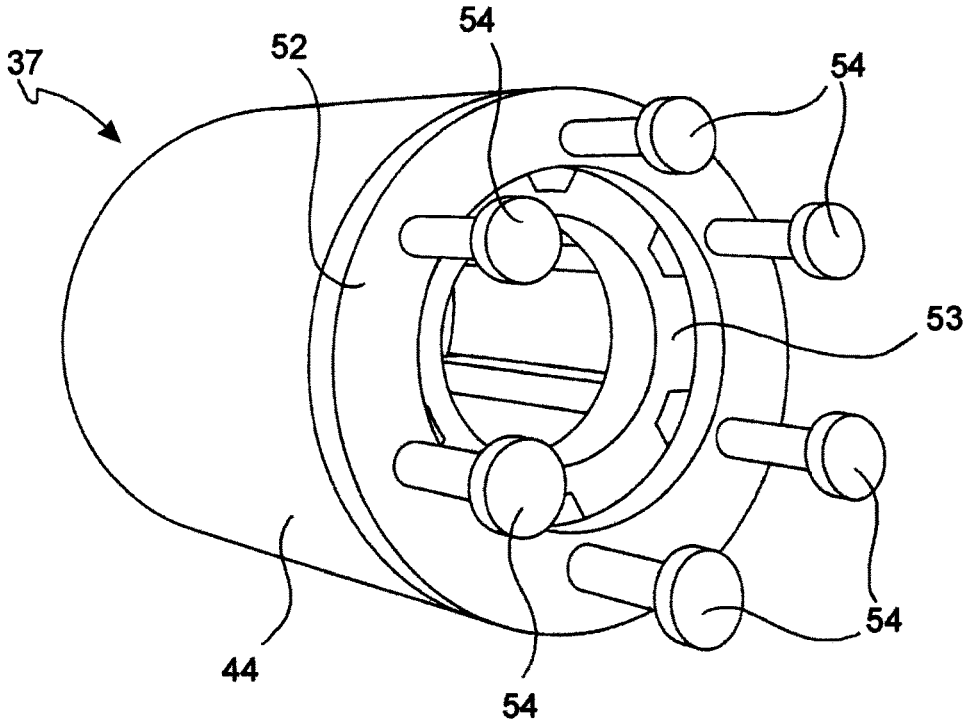

Again referring back to the embodiment of the FIGS. 1, 2, and 10*d*, the first rotor 37 further comprises an annular member 52 operatively associated, for example by screwing, to the first peripheral wall 40 of the first rotor 37, externally to the further housing 38. The annular member 52, transversally to the longitudinal development direction L of the body 2, has a dimension of the outer cylindrical cross-section substantially equal to the dimension of the outer cylindrical cross-section of the side wall 44 of the first rotor 37. Furthermore, the annular member 52, transversally to the longitudinal development direction L of the body 2, has a respective opening 53 having a cylindrical cross-section transversally to the longitudinal development direction L of the body 2 of a dimension preferably greater than the dimension of the cylindrical cross-section of the opening 43 of the second peripheral wall 42 of the first rotor 37.

Furthermore, the first rotor 37 comprises adjusting members 54, for example, screws, insertable into respective holes (not visible in the figures) present on the annular member 52.

It is pointed out that the adjusting members 54 are suitable to be inserted in the annular member 52 passing through respective through holes present on the first peripheral wall 10 of the first portion 8 of the body 2 so that the head of each adjusting member 54 abuts against the face of the first peripheral wall 10 of the first portion 8 of the body 2 (FIG. 2).

By a screwing/unscrewing of the adjusting members 54, it is possible to adjust the position, along the longitudinal development direction L of the body 2, of each of the plurality of ribs 45, within the first portion 4 of the housing 3. Referring now to the FIGS. 1, 2, 4 and 5, the second rotor 39, already mentioned above, comprises a first portion 55 suitable to be rotationally housed within the second portion 5 of said housing 3 of the body 2 about the longitudinal development direction L of such body 2.

The second rotor 39 further comprises a second portion 56 suitable to be rotationally housed within the further housing 38 defined by the first rotor 37 about the main development direction L of such body 2.

The second rotor 39 comprises a first peripheral body 57, an intermediate body 58, a connecting body 59 between the first peripheral body 57 and the intermediate body 58, a support body 60 of engaging members (described below) of the second rotor 39 with the first rotor 37 and a second peripheral body 61, opposite said first peripheral body 57.

Along the longitudinal development direction L of the body 2, the above-mentioned members are mutually operatively connected and aligned between the first peripheral body 57 and the second peripheral body, in the following order: first peripheral body 57, connecting body 59, intermediate body 58, support body 60 and second peripheral body 61. It shall be noticed that the first peripheral body 57, the intermediate body 58 and the connecting body 59 between the first peripheral body 57 and the intermediate body 58 substantially represent the first portion 55 of the second rotor 39. The support body 60 of engaging members of the second rotor 39 with the first rotor 37 and the second peripheral member 61 substantially represent the second portion 56 of the second rotor 39.

It shall be noticed that the connection between the first peripheral body 57 and the connecting body 59 is preferably obtained by screws. The connection between the connecting body 59 and the intermediate body 58 is preferably obtained by a glue or another compliant material or mechanism, in the case of a torsion which the lock 1 could be subjected to, at a stress threshold determined during the step of manufacturing the lock 1. This advantageously allows increasing the security of the lock.

The first peripheral body 57 is rotationally housed within the opening 19 of the second peripheral wall 18 of the second portion 9 of the housing 3, abutting against the seventh circular crown 34 present in the first end 25 of the body 2.

The first peripheral body 57 comprises a first plurality of through openings 62 (some being visible in FIG. 4), for example with a cylindrical cross-section, extending parallel to the longitudinal development direction L of the body 2. Transversally to the longitudinal development direction L of the body 2, the first plurality of through openings 62 is distributed so that the openings are mutually equidistant and arranged along a circumference having as its center the rotational axis of the second rotor 39.

Along the longitudinal development direction L of the body 2, each through opening has a peripheral portion 63 having a cylindrical cross-section of a first dimension and an inner portion 64 having a cylindrical cross-section of a second dimension.

The second dimension is preferably greater than the second dimension so as to define, within each opening, a further abutment circular crown. The first peripheral portion 57 of the second rotor 39 further comprises a first plurality of cylindrical members 65, each of which being housed within a through opening of said first plurality of through openings 62. The plurality of cylindrical members 65 is best shown in FIG. 10*b*.

In more detail, each cylindrical member of said first plurality 65 has a cylindrical cross-section of dimension substantially corresponding to the dimension of the cylindrical cross-section of the peripheral portion 63 of each through opening of said first plurality 62.

Each cylindrical member of said first plurality 65 further comprises a respective annular member 66 having cylindrical cross-section of dimension substantially corresponding to the dimension of the cylindrical cross-section of the inner portion 64 of each through opening of said first plurality 62.

The annular member 66 is suitable to define in the cylindrical member, along the longitudinal development direction L of the body 2, a respective peripheral portion 67 and a respective inner portion 68.

It shall be noticed that each cylindrical member of said first plurality of cylindrical members 65 is suitable to slide, parallel to the longitudinal development direction of the body 2, from a rest position to an operative position within a respective through opening of said first plurality of through openings 62 under the action of a respective thrust member insertable in the through opening according to the insertion direction I. It shall be noticed that each thrust member suitable to push each cylindrical member of said first plurality 65 is part of a plurality of thrust members present in a key usable for actuating the lock 1, which will be described in detail below.

The rest position of each cylindrical member corresponds to the position in which the annular member 66 is in abutment against the further circular crown present within the respective through opening while the operative position of each cylindrical member corresponds to the position wherein the annular member 66 moves away from the further circular crown.

It shall be noticed that each cylindrical member is also suitable to slide from the operative position to the rest position under the action of a spring or any other equivalent elastic means connected with the annular member 66 and suitable to wrap the peripheral portion 68 of the cylindrical member. It shall be noticed that the peripheral portion 67 and/or the inner portion 68 of a cylindrical member of said plurality 65 may have, along the longitudinal development direction L of the body 2, the same or different lengths with respect to the length of the peripheral portion 67 and/or of the inner portion 68 of another cylindrical member of the above-mentioned plurality 65.

It shall be noticed that the definition of the lock 1 actuation code depends on the definition of such lengths. Furthermore, as already stated above, the actuation code of the lock 1, also depends on the position of the plurality of ribs 45 along the longitudinal development direction L of the body 2.

Therefore, it is advantageously possible to create a different actuation code of the lock 1 by changing the length, along the longitudinal development direction L of the body 2, of the cylindrical members of said plurality (peripheral portion 67 and/or inner portion 68) and/or the position, along the longitudinal development direction L of the body 2, of the plurality of ribs 45.

It shall be noticed that each cylindrical member is also suitable to slide from the operative position to the rest position under the action of a spring or any other equivalent elastic means connected with the annular member 66 and suitable to wrap the peripheral portion 68 of the cylindrical member.

The first peripheral body 57 further comprises a cavity C1 arranged substantially in the center of the cylindrical cross-section of the first peripheral body 57, parallel to the longitudinal development direction L of the body 2. Such cavity is suitable to house an end of a longitudinal connecting member 69 of the second rotor 39.

The connecting body 59 of the second rotor 39 comprises a peripheral portion 70, facing the first peripheral body 57 and an inner portion 71, facing the intermediate body 58.

The peripheral portion 70, in a direction orthogonal to the longitudinal development direction L of the body 2, has a cylindrical cross-section of dimension substantially corresponding to the dimension of the cylindrical cross-section of the first peripheral body 57.

The inner portion 71, in a direction orthogonal to the longitudinal development direction L of the body 2, has a cylindrical cross-section with a dimension larger than the dimension of the cylindrical cross-section of the peripheral wall 70.

The dimension difference between the cylindrical cross-section of the peripheral wall 70 and of the inner wall 71 defines a respective circular crown 72 suitable to abut against the third circular crown 22 defined in the second portion 9 of the body 2.

The connecting body 59 further comprises a second plurality of through openings 73 (some being visible in FIG. 4), for example of cylindrical cross-section, extending parallel to the longitudinal development direction L of the body 2. Transversally to the longitudinal development direction L of the body 2, the second plurality of through openings 73 is distributed so that the openings are mutually equidistant and arranged along a circumference having as its center the rotational axis of the second rotor 39.

Along the longitudinal development direction L of the body 2, each through opening has a cylindrical cross-section of dimension substantially equal to the peripheral portion 63 of a through opening of said first plurality of through openings 62.

It shall be noticed that the second plurality of through openings 73 is aligned with the first plurality of through openings 62 of the first peripheral body 57.

The connecting body 59 is also provided with a first through opening C2 arranged substantially in the center of the transversal cylindrical cross-section of the intermediate body 58, parallel to the longitudinal development direction L of the body 2.

Such first through opening C2 is substantially aligned with the cavity C1 present in the first peripheral body and it is suitable to house a portion of the longitudinal connecting member 69 of the second rotor 39.

The intermediate body 58 of the second rotor 39 comprises a first peripheral portion 74, a second peripheral portion 75, and a central portion 76 interposed between said first peripheral portion 74 and said second peripheral portion 75. The first peripheral portion 74 faces the connecting body 59, while the second peripheral portion 75 faces the support body 60.

The first peripheral portion 74, in a direction orthogonal to the longitudinal development direction L of the body 2, has a cylindrical cross-section of dimension substantially equal to the dimension of the cylindrical cross-section of the inner wall 71 of the connecting body 59.

The central portion 76, in a direction orthogonal to the longitudinal development direction L of the body 2, has a cylindrical cross-section of a dimension lesser than the dimension of the cylindrical cross-section of the first peripheral portion 74.

It shall be noticed that the central portion 76, along the longitudinal development direction L of the body 2, has an outer surface comprising a plurality of recesses 77 (visible in FIG. 10*a*) extending parallel to the longitudinal development direction L of the body 2 substantially throughout the length of the central portion 76.

The second rotor 39 comprises a first toothed wheel 78 having a through opening such as to allow the engagement of the first toothed wheel 78 with the central portion 58 of the second rotor 39. The first toothed wheel 78 is suitable to engage with a second toothed wheel 79 (visible in FIG. 10*a*) of the opening/closing mechanism actuatable by the lock 1 in a respective actuating position of the lock, as it shall be described below.

The intermediate body 58 further comprises a third plurality of through openings 80 (some being visible in FIG. 4), for example of cylindrical cross-section, extending parallel to the longitudinal development direction L of the body 2 within the first peripheral portion 74 and of the central portion 76. Transversally to the longitudinal development direction L of the body 2, the third plurality of through openings 80 is distributed so that the openings are mutually equidistant and arranged along a circumference having as its center the rotational axis of the second rotor 39.

Along the longitudinal development direction L of the body 2, each through opening has a cylindrical cross-section of dimension substantially equal to the cylindrical dimension of each through opening of the second plurality of through openings 73.

It shall be noticed that the third plurality of through openings 80 is aligned with the second plurality of through openings 73 of the connecting body 59.

The central body 58 is also provided with a second through opening C3 arranged substantially in the center of the transversal cylindrical cross-section of the central body 58, parallel to the longitudinal development direction L of the body 2.

Such second through opening C3 is substantially aligned with the first through opening C2 and it is suitable to house a further portion of the longitudinal connecting member 69 of the second rotor 39.

Referring generally back to the second rotor 39, it comprises a second plurality of cylindrical members 81, each of which being housed within a through opening defined by a through opening of said third plurality of through openings 80 aligned with a respective through opening of the second plurality of through openings 73.

Each cylindrical member of said second plurality 81 has a cylindrical cross-section of dimension substantially corresponding to the dimension of the cylindrical cross-section of each through opening of said third plurality of through openings 80 or said second plurality of through openings 73.

Each cylindrical member of said second plurality 81, along the longitudinal development direction L of the body 2, preferably has a length lesser than the length of the through opening defined by a through opening of the third plurality of through openings 80 aligned at a respective through opening with the second plurality of through openings 73.

It shall be noticed that each cylindrical member of said second plurality of cylindrical members 81 is suitable to slide, parallel to the longitudinal development direction L of the body 2, from a rest position to an operative position within the respective through opening under the action of a respective cylindrical member of said first plurality 65.

The second plurality of cylindrical members 81 is visible also in FIG. 10*b*.

The second peripheral portion 75 of the central body 58 of the second rotor 39 comprises a peripheral wall 82, facing the support body 60, and a connecting wall 83 interposed between the central portion 76 and the peripheral wall 82.

The peripheral wall 82, along the longitudinal development direction L of the body 2, has a cylindrical cross-section with a dimension larger than the dimension of the cylindrical cross-section of the central portion 76.

The connecting wall 83, along the longitudinal development direction L of the body 2, has a cylindrical cross-section gradually increasing starting from the central portion 76 up to the peripheral wall 82, so as to define an outer profile of the connecting wall 83 that is inclined, with respect to the longitudinal development direction L of the body 2, by a determined inclination angle.

The connecting wall 83 is suitable to define a respective housing 83' having, along the longitudinal development direction L of the body 2, a frusto-conical section.

The support body 60 of engaging members (described below) of the second rotor 39 with the first rotor 37, comprises a first outer portion 60' and a second inner portion 60".

The first outer portion 60', along the longitudinal development direction L of the body 2, has a cylindrical cross-section of dimension substantially equal to the dimension of the outer cylindrical cross-section of the peripheral wall 82 of the second peripheral portion 75 of the intermediate body 58.

The second inner portion 60" is suitable to be housed within the further housing 83' defined in the connecting wall 83. The second inner portion 60', along the longitudinal development direction L of the body 2, has a frusto-conical section the outer surface of which is inclined, with respect to the longitudinal development direction L of the body 2, by the determined inclination angle.

Referring back to the first outer portion 60', it further comprises a plurality of support guides 84.

Each support guide of said plurality 84 extends, along an inclined direction with respect to the longitudinal development direction L of the body 2 by the determined inclination angle, from the second inner portion 60" to the outer surface of the first outer portion 60'.

Each support guide of said plurality 84 is an extension of the outer surface of the second inner portion 60" of the support body 60.

Each support guide of said plurality 84 is distributed in the first outer portion 60' so as to be equidistant from each of the adjacent support guides and so as to be substantially aligned with a respective through opening of said third plurality of through openings 80.

The first outer portion 60' of the support body 60 further comprises a plurality of grooves 84', each being obtained within the first outer portion 60' starting from a portion of each support guide of said plurality 84.

The support body 60 is also provided with a third through opening C4 arranged substantially in the center of the transversal cylindrical cross-section of the support body, parallel to the longitudinal development direction L of the body 2.

Such third through opening C4 is substantially aligned with the second through opening C3 that is present in the intermediate body 58 and is suitable to house a further portion of the longitudinal connecting member 69 of the second rotor 39.

The second rotor 39 further comprises a first plurality of engaging members 85 of said second rotor 39 with said first rotor 37, each being slidably housable within a respective support guide of the above-mentioned plurality 84.

Figure 8A:
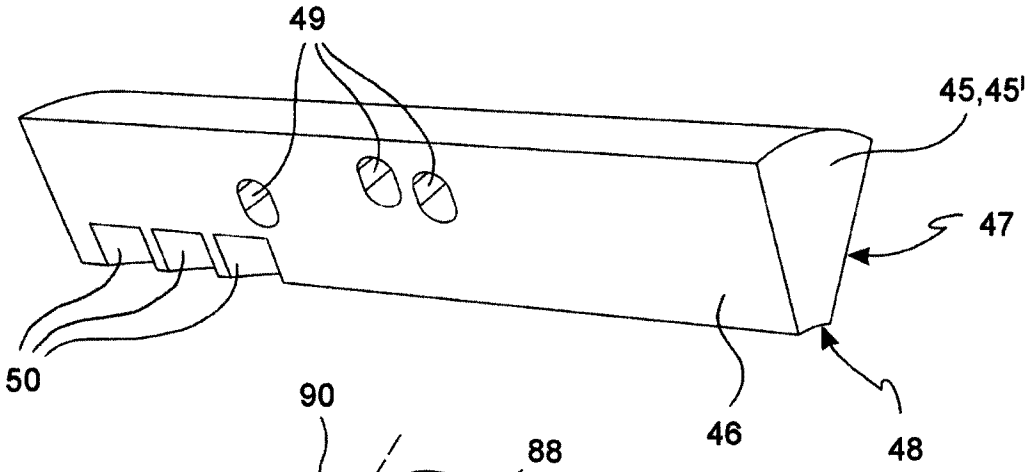
FIGS. 8*a* and 8*b* schematically illustrate in a perspective view of two further inner components of the mechanical lock of FIG. 1.
Figure 8B:
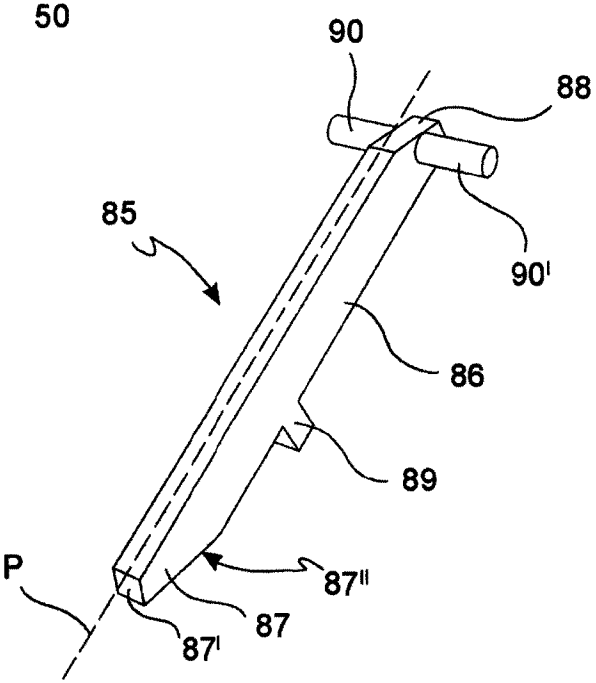
Figure 9:
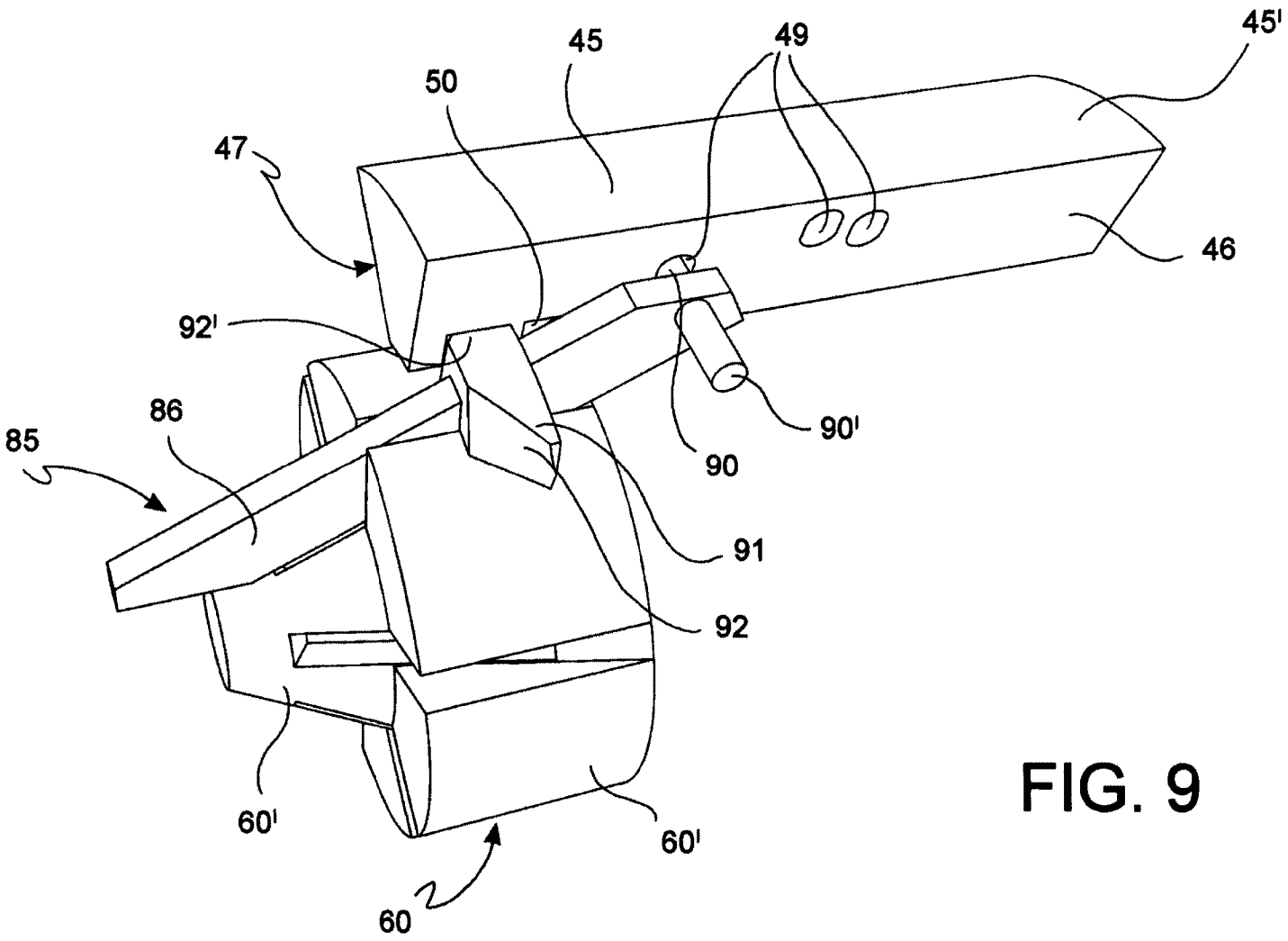
FIG. 9 schematically illustrates in perspective view an inner portion of the mechanical lock of FIG. 1 in which the two further components of the FIGS. 8*a* and 8*b* are in an operative condition.

An example of an engaging member of the above-mentioned first plurality 85 will be now described with particular reference to the FIGS. 8*b* and 9.

The engaging member 85 comprises a main body 86, for example, a plate, having a respective longitudinal development direction P.

The engaging member 85 comprises a first end 87 and a second end 88, opposite said first end 87.

The first end 87 is shaped so as to have a first face 87', preferably orthogonal to the longitudinal development direction L of the body 2, and a second face 87", preferably parallel to the longitudinal development direction L of the body 2.

When it is housed within the respective support guide, the engaging member 85 is suitable to translate along the longitudinal development direction P of the main body 86 from a respective rest position to an operative position. In more detail, the engaging member 85 assumes the rest position when the first face 87' abuts against the free end of a respective cylindrical member of said second plurality of cylindrical members 81 (as it can be seen in FIG. 10*b*), opposite the end that is suitable to abut against a respective cylindrical member of the first plurality of cylindrical members 65, and the second face 87" abuts against the longitudinal member 69 of the second rotor 39.

It shall be noticed that when the engaging member 85 is housed within the respective support guide, the main development direction P of the engaging member 85 is inclined with respect to the longitudinal development direction L of the body 2 by an angle that is equal to the determined inclination angle, as defined above.

The engaging member 85 is also provided with a notch 89 extending from the main body 86 downwardly, orthogonal to the longitudinal development direction P of the main body 86.

In more detail, when the engaging member 85 is housed within the respective support guide, the notch 89 is suitable to be housed within a respective groove of the above-mentioned plurality of grooves 84' of the first outer portion 60' of the support body 60. When the engaging member 85 is in the rest position, the notch 89 abuts against an edge of the groove within which it is housed.

It is pointed out that each engaging member 85 is suitable to slide from the operative position to the rest position under the action of a spring or any other equivalent elastic means connected with the respective notch 89 and suitable to be also housed within the groove in which the notch 89 is housed. The engaging member 85, at the second end 88, is also provided with a first pin 90 and with a second pin 90' extending preferably orthogonally to the longitudinal development direction P of the main body 86.

The first pin 90 is suitable to engage with any of the holes of the first plurality of holes 49 distributed on the first radial wall 46 of said at least one rib 45' of said plurality of ribs 45 of the first rotor 37, as shown in FIG. 9.

The second pin 90' is suitable to engage with any of the holes of the second plurality of holes (not visible in the figures) distributed on the second radial wall of said at least one further rib 45" of said plurality of ribs 45, adjacent to said at least one rib 45'.

Furthermore, the second rotor 39 comprises a second plurality of engaging members 91 of the second rotor 39 with said first rotor 37.

Each engaging member of said second plurality 91 is operatively associated with the outer surface of the support body 60 at a respective support guide of said plurality of support guides 84.

In more detail, each engaging member of said second plurality 91 comprises a respective groove suitable to slidably receive the upper part of a respective engaging member of the first plurality 85. In other words, each engaging member of said second plurality 91 is suitable to constrain the translation of the respective engaging member of said first plurality 85 along the longitudinal development direction P of the main body 86 within the support guide of said plurality of support guides 84.

Furthermore, each engaging member of said second plurality 91, transversally to the longitudinal development direction L of the body 2, comprises a first end 92 and a second end 92'.

The first end 92 is suitable to engage with any of the notches of the first plurality of notches 50 distributed on said at least one rib 45' of said plurality of ribs 45 with which the first rotor 37 is provided. In a completely similar manner, the second end 92' is suitable to engage with any of the notches of the second plurality of notches 51 distributed on said at least one further rib of said plurality of ribs 45 with which the first rotor 37 is provided.

It shall be noticed that each engaging member of the first plurality 91, when one of the ends is engaged with a respective notch, advantageously represents a thrust means of the first rotor 37. Furthermore, during the step of disengaging of the second rotor 39 from the first rotor 37, each engaging member of the first plurality 91, in view of its geometrical shape along the longitudinal development direction L of the body 2, advantageously represents a disengaging means of the second rotor 38 from the first rotor 37.

The second peripheral body 61 of the second rotor 39 comprises a main body 93 and an inner wall 94. The inner wall 94 is arranged between the main body 93 of the second peripheral body 93 and the support body 60 of the second rotor 39.

The main body 93, along the longitudinal development direction L of the body 2, has a cylindrical cross-section with a dimension lesser than the dimension of the cylindrical cross-section of the inner wall 94.

The difference between the cylindrical cross-section of the inner wall 94 and the main body 93 is suitable to define a further circular crown 94' on which one or more springs or any other equivalent elastic means are present, under the action of which the second rotor 39 is brought, along the longitudinal development direction L of the body 2, from an operative position to a rest position.

The second peripheral body 61 is also provided with a fourth through opening C5 arranged substantially in the center of the transversal cylindrical cross-section of the second peripheral body 61, parallel to the longitudinal development direction L of the body 2.

Such fourth through opening C5 is substantially aligned with the third through opening C4, and it is suitable to house a further portion of the longitudinal connecting member 69 of the second rotor 39.

In accordance with a further embodiment (not shown in the figures) of the first rotor 37, the first plurality of holes distributed on the first radial wall of each rib, and the second plurality of holes distributed on the second radial wall of each rib can be replaced, respectively, by a plurality of seats, each extending radially with respect to the longitudinal development direction L of the body 2.

Mutually facing seats have the same position and define a pair of seats. Instead, pairs of seats have mutually different positions.

The different positions of each pair of seats correspond to an actuation code of the lock 1 with a respective key of a hierarchic key system ("User key", "Master Key", "General Master Key").

In accordance with this embodiment, the second rotor 39 can be provided with engaging members of said second rotor with said first rotor, in the form of cylindrical pins extending radially with respect to the longitudinal development direction L of the body 2.

Each engaging member (pin) is suitable to slide along the longitudinal development direction L of the body 2 so as to face one of the above-mentioned seats of each of the pluralities of seats that are present on the first rotor and, following the rotation of the second rotor, it is suitable to rotate along the longitudinal development direction L of the body 2 so that its free end engages with the respective seat, allowing the engagement between said second rotor and said first rotor.

Particularly referring now to the FIGS. 1, 2, 6, 7, 10*e*, 10*f*, and 10*g*, a mechanical actuator of the lock 1 is now described.

The mechanical actuator of the lock 1, generally indicated with the numeral reference 100 (FIG. 10*f*), comprises a first component 101 rotationally housed within the first portion 4 of the housing 3 of the body 2.

The first component 101 is provided with a through opening so shaped as to engage with the outer surface of the second peripheral body 61 (also illustrated in the above-mentioned figures) of the second rotor 39. The second peripheral body 61 is suitable to slide along the longitudinal development direction L of the body 2 within the through opening 102 of the first component 101. The first component 110 is suitable to translate within the through opening 11' defined by the inner wall 14 of the first portion 8 of the body 2.

Therefore, the first component 101 is suitable to translate along the longitudinal development direction L of the body 2 with respect to both the second peripheral body 61 of the second rotor 39 and the inner wall 104 of the first portion 8 of the body 2.

Figure 10E:
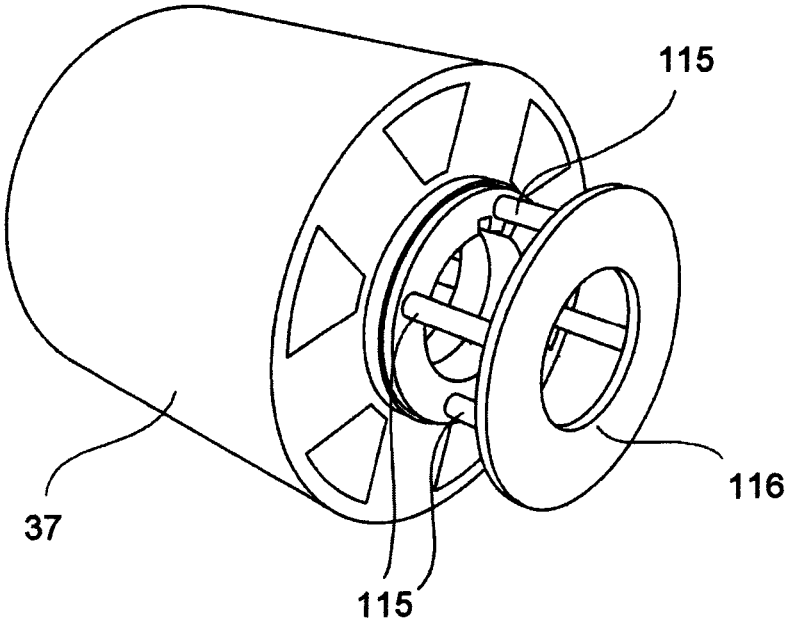
Figure 10F:
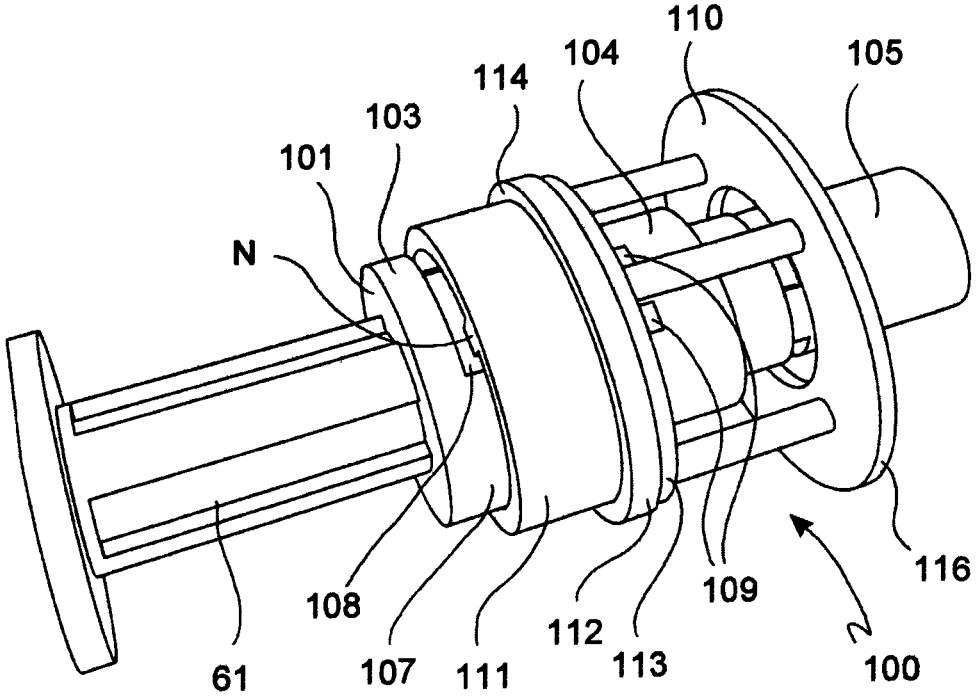
Figure 10G:
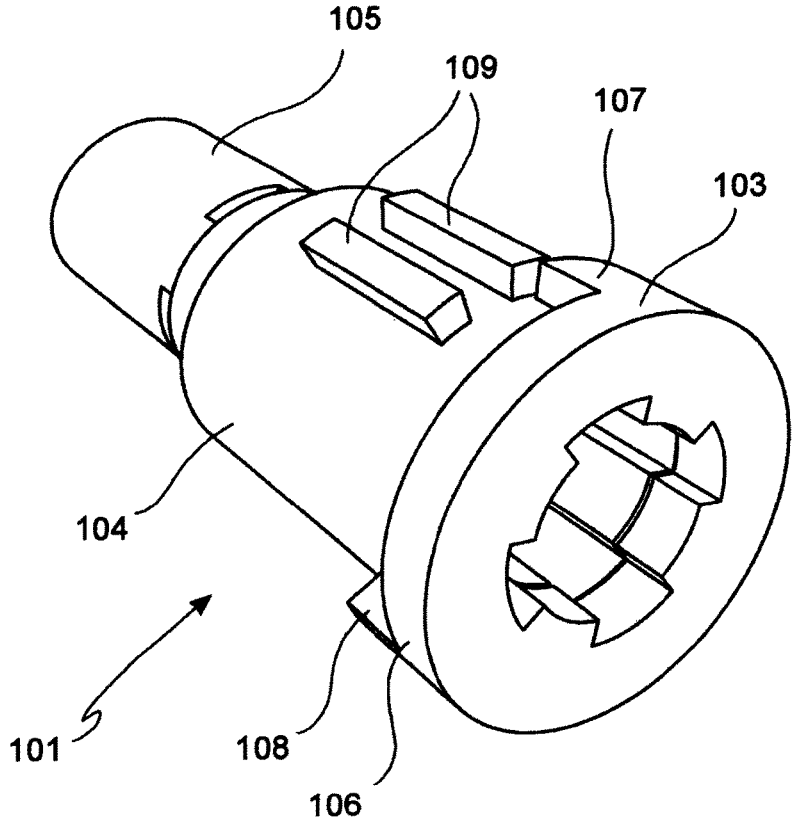

In order to promote the understanding of the actuator 100 mechanism, the inner wall 104, that is a part of the body 2 (as stated above) is illustrated both in FIG. 10*f* and in FIG. 10*g*. It shall be noticed that the inner wall 104 of the body 2 is stationary, i.e., during the actuation of the mechanism of the actuator 100, it is not subjected to any translations along the longitudinal development direction L of the body 2, not to any rotations about the longitudinal development direction L of the body 2.

The first component 101 comprises a first peripheral stop member 103 and a second peripheral member 105. The first peripheral stop member 103 faces the second rotor 39.

The first peripheral stop member 103 is suitable to define the through opening 102 of the first component 101. The second peripheral member 105 is suitable to define a further through opening suitable to receive an end of the longitudinal connecting member 69 of the second rotor 39.

The first peripheral member 103 comprises a first peripheral wall 106 and a second inner wall 107. The second inner wall 107 is suitable to define a radial opening 108. The first peripheral wall 106 and the second inner wall 107 preferably have cylindrical cross-section with the same dimension, along the longitudinal development direction L of the body 2.

The first peripheral wall 106 and the second inner wall 107, along the longitudinal development direction L of the body 2, have a cylindrical cross-section with a dimension greater than the cylindrical cross-section of the inner wall 104 of the first portion 8 of the body 2. At the radial opening 108, the second inner wall 107 has a cylindrical cross-section of dimension equal to the dimension of the cylindrical cross-section of the inner wall 104 of the first portion 8 of the body 2.

As best shown in FIG. 10*g*, it shall be noticed that the inner wall 104 of the first portion 8 of the body 2 comprises, on the outer surface thereof, at least two ribs 109 extending parallel to the longitudinal development direction L of the body 2.

In a further embodiment (not shown in the figures), complementary to the one just described, the inner wall 104 of the first portion 8 of the body 2 comprises, on the outer surface thereof, transversally to the longitudinal development direction L of the body 2, at least one circular stop crown suitable to define a seat completely equivalent to the seat defined by the two ribs 109 extending parallel to the longitudinal development direction L of the body 2 that are present in the embodiment described above and illustrated, for example, in FIG. 10*g*.

Referring back to the mechanical actuator 100 of the lock 1, it further comprises a second component 110 that can be housed within the first portion 4 of the housing 3 of the body 2.

The second component 110 is operatively connected with the first rotor 37 (FIG. 10*e*).

The second component 110 is advantageously suitable to translate, integrally with the first rotor 37, along the longitudinal development direction L of the body 2.

In more detail, the second component 110 comprises a first peripheral wall 111, a central wall 112 and a second peripheral wall 113.

The first peripheral wall 111, along the longitudinal development direction L of the body 2, has a cylindrical cross-section of dimension equal to the dimension of the opening 41 present on the first peripheral wall 40 of the first rotor 37. To this aim, the first peripheral wall 111 is suitable to be inserted within the above-mentioned opening 41.

The central wall 112, along the longitudinal development direction L of the body 2, has a cylindrical cross-section with a dimension larger than the dimension of the cylindrical cross-section of the first peripheral wall 111.

The dimension difference between the cylindrical cross-section of the first peripheral wall 111 and the central wall 112 defines a further circular crown 114 for the abutment of the first peripheral wall 40 of the first rotor 37.

The second peripheral wall 113, along the longitudinal development direction L of the body 2, has a cylindrical cross-section with a dimension lesser than the dimension of the central wall 112.

Furthermore, it shall be noticed that the peripheral wall 111, the central wall 112 and the second peripheral wall 113 define a through opening within which the inner wall 104 of the first portion 8 of the body 2 can be housed. To this aim, the second component 110 comprises a rib N (FIG. 10*f*) extending parallel to the longitudinal development direction L of the body 2, defined on the inner surface of the peripheral wall 111, of the central wall 112 and of the second peripheral wall 113.

Such a rib N, in the embodiment illustrated in the figures, is suitable to slide along the longitudinal development direction L of the body 2 within said at least two ribs 109 defined on the outer surface of the inner wall 104 of the first portion 8 of the body 2.

At the same manner, such rib N, in the embodiment not illustrated in the figure, is suitable to slide along the longitudinal development direction L of the body 2 within the seat defined by the circular stop crown that is present on the outer surface of the inner wall of the body 2 first portion.

Furthermore, such rib N is suitable to slide with respect to the second inner wall of the first peripheral stop member 103 to bring the second component 110 of the mechanical actuator 100 from a locking position to an unlocking position with respect to the first component 101.

The locking position occurs when the rib N is engaged with the second inner wall of the first peripheral stop member 103 within the radial opening 108. The unlocking position occurs when the rib N is disengaged from the second inner wall of the first peripheral stop member 103.

To this aim, the second component 110 of the actuator 100 is suitable to translate along the longitudinal development direction L of the body 2 between a locking position and an unlocking position of the actuation mechanism of the lock.

In the locking position, the rib N of the second component is suitable to radially engage with the second inner wall 107 of the first peripheral stop member 103 of the first component 101, inhibiting the rotation of the first component 101 about the longitudinal development direction L of the body 2. In the unlocking position, the rib N of the second component 110 is in a radial disengagement with respect to the second inner wall 107 of the first peripheral stop member 103 of the first component 101, allowing the rotation of the first component 101 about the longitudinal development direction L of the body 2.

The second component 110 further comprises an outer wall 114 suitable to define, orthogonally to the longitudinal development direction L of the body 2, a circular crown (best shown in the FIGS. 10*e* and 10*f*). The outer wall 114 is suitable to define a respective through opening within which the second peripheral member 105 of the first component 101 can be housed.

The outer wall 114 is operatively connected with the second peripheral wall 113 of the second component 110 by a plurality of cylindrical connecting members 115.

It shall be noticed that the outer wall 114 is external to the second portion 9 of the body 2.

Particularly, the first peripheral wall 10 of the first portion 8 of the body 2 is provided with further through holes, each being suitable to house a cylindrical connecting member of the above-mentioned plurality 115.

It shall be noticed that, in a completely similar manner to the adjusting members 54 of the first rotor 37, also the outer wall 114 is suitable to abut against the outer face of the first peripheral wall 10 of the first portion 8 of the body 2.

Furthermore, it is pointed out that the second component 110 of the actuator 100 is suitable to pass parallel to the longitudinal development direction L of the body 2 from the unlocking position to the locking position (defined above) under the action of a spring or any other equivalent elastic means with which the second peripheral wall 113 is provided at each cylindrical connecting member of the above-mentioned plurality 115.

In addition, it shall be noticed that the outer wall 114 and the heads of the adjusting members 54 of the first rotor 37 are preferably protected by the cover member 116 of the body 2 (as already defined above).

In accordance with the embodiment of the figures, the actuator 100 further comprises a knob 117, for example, having a cylindrical shape, comprising a longitudinal portion 118 suitable to be connected with the second peripheral member 105 of the first component 101 through the through opening of the cover member 116.

The knob 117 is suitable to allow bringing the first component 101 of the mechanical actuator 100 from the locking position to the unlocking position with respect to the second component 110. The knob 117 is preferably present only on one end of the lock 1, opposite the one for the insertion of the key, for example, the end accessible from a door side facing inwardly of a room.

In accordance with a further embodiment, alternatively or in combination with the mechanical actuator 100, the first component 101 can be provided with an electronic board and a solenoid (not shown in the figures).

The electronic board, based on the code of the actuation key of the lock 1 digitally provided by an electronic card that can be brought near to the lock 1 to open it, in place of the actuation key, is suitable to actuate the solenoid. Based on the received electric signal, the solenoid is suitable to translate the second component 110 with respect to the first component 101 of the mechanical actuator 100 along the longitudinal development direction L of the body 2, in order to obtain the disengagement of the rib N of the second component 110 from the first peripheral stop member 103.

In accordance with a further embodiment, the first component 101 of the mechanical actuator 100 can be provided with a solenoid suitable to lock, based on an electric signal received from an electronic control panel remote with respect to the lock 1, the translation of the second component 110 with respect to the first component 101 inhibiting the opening of the lock 1 not with the right key.

In a complementary manner, in accordance with a further embodiment, the above-mentioned solenoid, based on an electric signal received from the electronic control panel remote with respect to the lock, is suitable to unlock the translation of the second component 110 with respect to the first component 101, thus promoting the lock 1 opening also without a key.

Figure 11:
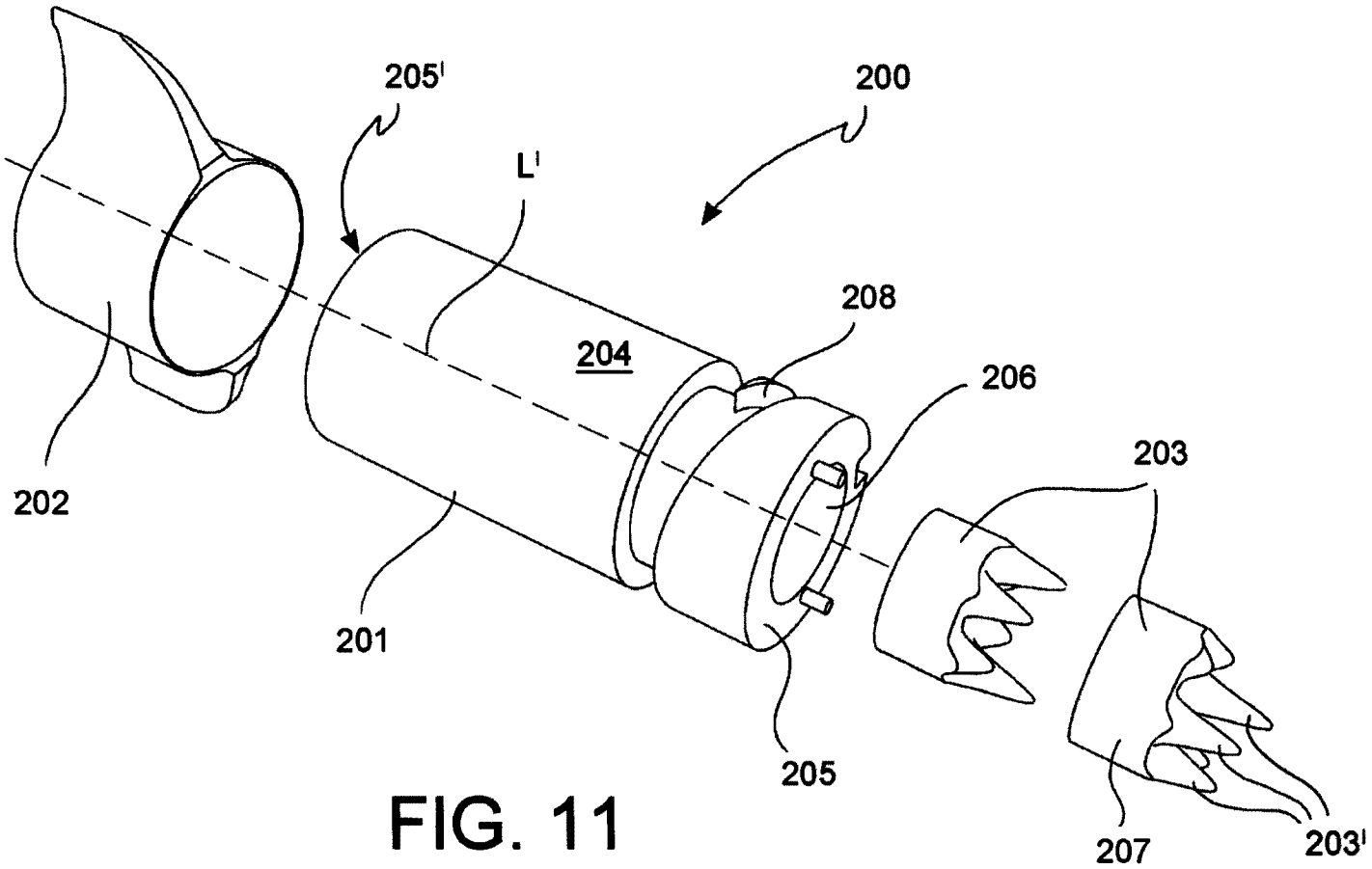
FIG. 11 schematically illustrates a perspective view of an exploded view of a key usable with the mechanical lock of FIG. 1, according to an embodiment of the invention, and FIG. 12 schematically illustrates side sectional views of the key of FIG. 10.
Figure 12:
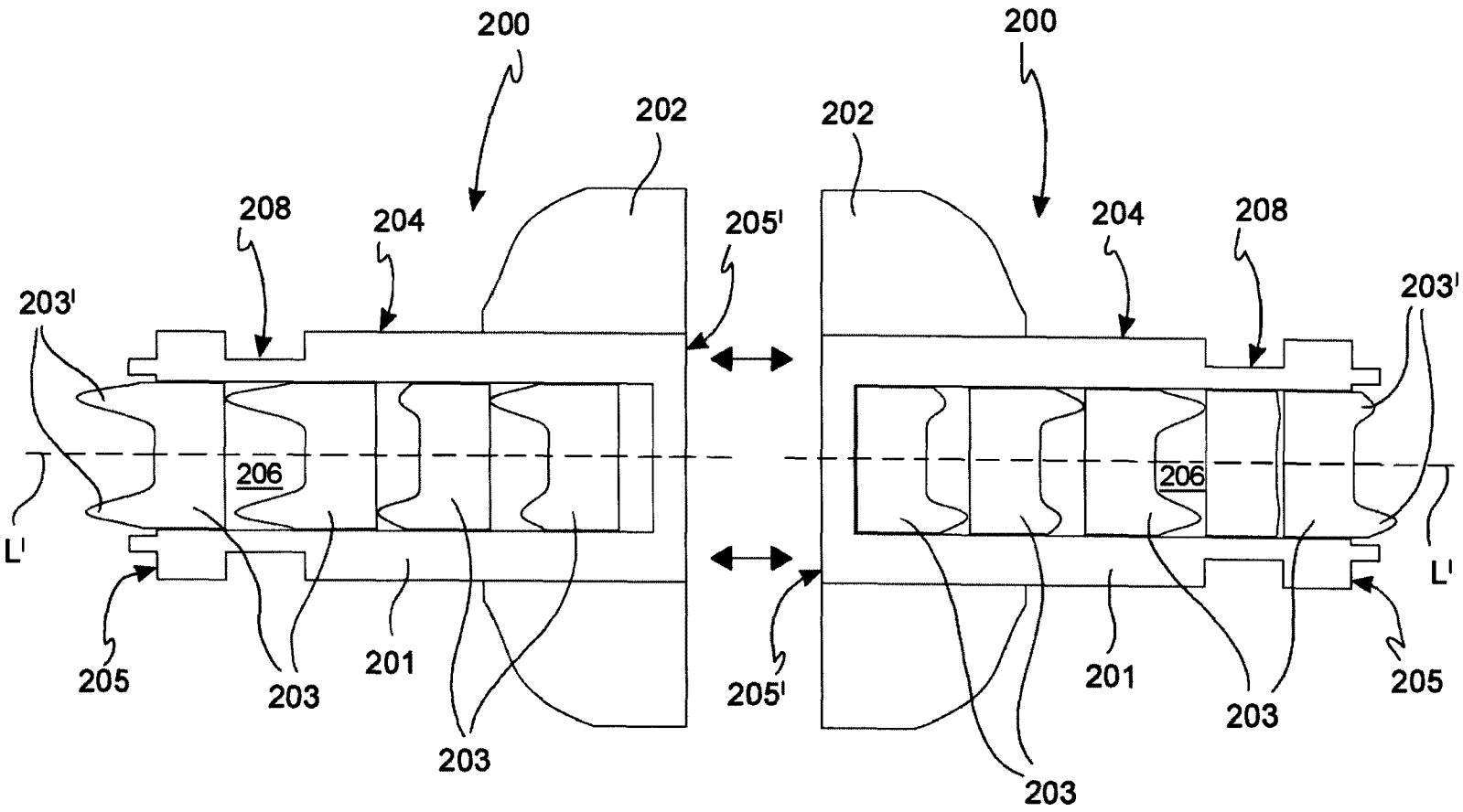

Referring now to the FIGS. 11 and 12, an actuation key of the lock 1 according to an embodiment of the invention is now described.

The actuation key 200, herein below also simply referred to as a key, comprises a main body 201, preferably having a cylindrical shape, a gripping knob 202 and a code-holder member 203.

The main body 201, having a longitudinal development direction L', comprises a side wall 204, a first base 205, and a second base 205', opposite said first base 205.

The second base 205' is a bottom wall of a cavity 206 that is present within the main body 201 starting from a respective opening obtained on the first base 205.

At the second base 205', the main body 201 is operatively connected with the gripping knob 202.

The code-holder member 203 suitable to engage with the lock 1, as it shall be described below, can be housed within the cavity 206.

It shall be advantageously noticed that the cavity 206 is suitable to hold more than one code-holder member 203, among which only the one at the top will be used to open the lock 1 (FIG. 12).

Therefore, the key 200 can act as a container for multiple code-holder members that can be mutually interchangeable so as to be able to still use the same main body with a gripping knob to open different locks, one for each code-holder member that can be housed within the cavity 206.

The code-holder member 203 comprises a plurality of thrust members 203', already set forth above, extending from a cylindrical base 207 along the longitudinal development direction L' of the main body 201.

Each thrust member 203' is suitable to be inserted within a through opening of the first plurality of through openings 62 that is present in the first peripheral portion 57 of the second rotor 39. Furthermore, each thrust member is suitable to abut against and translate along the longitudinal development direction L of the body 2, together with a respective cylindrical member of the first plurality of cylindrical members 65, in order to transfer the code of the key to open the lock 1.

As already stated above, along the longitudinal development direction L' of the main body 201, each thrust member of said plurality 203' preferably has a different length from the other thrust members.

Furthermore, it is pointed out that the surface or point for the abutment of each thrust member of the plurality 203' with the respective cylindrical member of said first plurality of cylindrical members 65 may have any shape or configuration. At the same manner, the surface or point for the abutment of each cylindrical member of said first plurality of cylindrical members 65 with the respective thrust member of the plurality 203' may have any shape or configuration. The characteristic that needs to be maintained unaltered during the abutment of the above-mentioned members, in order to ensure the transfer of the actuation code of the lock 1 and the proper operation of the opening mechanism, is the length, along the longitudinal development direction L of the body 2.

The main body 201 of the key 200 comprises a coil groove 208, already set forth above, obtained on the side wall 204 starting from the first base 205.

Such coil groove 208 is suitable to engage with the tooth 35 defined on the surface 36 of the frusto-conical section obtained at the first opening 32 of the inner wall 29 of the first end 25 of the body 2.

It shall be noticed that the first base 205 is preferably provided with two pins, extending parallel to the longitudinal development direction L' of the main body 201, suitable to engage with respective holes that are present in the first peripheral portion 57 of the second rotor 39.

The engagement of such pins with the respective holes advantageously allows the engagement of the tooth 35 with the beginning of the coil groove 208.

It shall be noticed that the sliding of the tooth 35 within the coil groove 208 allows obtaining a translation movement of the key by simply rotating the key along the insertion direction I, parallel to the longitudinal development direction L of the body 2.

Referring back to the code-holder member 203, it is pointed out that the cylindrical base 207, along the longitudinal development direction L' of the main body 201, has a length representative of the code of a key, within a hierarchic key system, as already defined above.

For example, a code-holder member may have the respective cylindrical base of a first length (for example, 0.5 mm) representative of the first code of the first key, for example, a user key, of a second length (for example, 0.8 mm) representative of the second code of the second key, for example, a master key, or a third length (for example, 2.2 mm) representative of the third code of the third key, for example, a general master key.

As it will be also described below, the use of a code-holder member with a cylindrical base having the first, the second or the third length will allow obtaining the engagement position between the first rotor 37 and the second rotor 39 by the engagement of the engaging member of the first plurality of the engaging members 85 and the engaging member of said second plurality of engaging members 91, respectively, for example, with the first, second, or third holes of the first plurality of holes 49 and the first, second, or third notches of the first plurality of notches 51 that are present on said at least one rib 45' of the plurality of ribs 45 of the first rotor 37.

Referring generally back to the second rotor 39, it is pointed out that it, by the insertion of the key 200 into the second rotor 39, is advantageously suitable to translate along the longitudinal development direction L of the body 2.

In fact, following the insertion of the key 200, the second rotor 39, under the thrust action of the plurality of thrust members of the code-holder member 203 with which the key 200 is provided, is suitable to translate with respect to the first rotor 37, along the longitudinal development direction L of the body 2, in order to allow the pins of the first plurality of engaging members 45 facing the respective hole of said first plurality of holes 49 and second plurality of holes, and the second engaging members 91 facing the respective notch of said first plurality of notches 50 and said second plurality of notches 51 present on the second rotor 39.

Furthermore, by a first rotation portion of the key 200, the second rotor 39 is suitable to rotate about the longitudinal development direction L of the body 2 with respect to the first rotor 37, to pass from a disengagement position to an engagement position with the first rotor 37.

In fact, as stated above, the tooth 35 is suitable to slide within the coil groove of the key 200 converting the rotational movement of the key 200 into a translational movement.

During the first rotation portion of the key 200, the second rotor 39 is suitable to rotate about the longitudinal development direction L of the body 2 in order to allow the insertion of one of the pins of the first engaging members 45 in the respective target hole and the insertion of the second engaging members 91 within the respective target notch, thus reaching an engagement position between the first rotor 37 and the second rotor 39.

In said engagement position, the first rotor 37 and the second rotor 39, by a second portion of rotation of the key 200, are suitable to integrally translate along the longitudinal development direction L of the body 2 to reach an actuating position of the lock 1.

In fact, again under the action of the tooth 35 suitable to slide within the coil groove of the key 200, the first rotor 37, under the action of the second rotor 39, is suitable to translate along the longitudinal development direction L of the body 2 together with the second component 110 of the locking/unlocking mechanism 100 of the lock 1 so as to disengage the rib N of the second component 110 from the first peripheral stop member 103 of the first component 101, hence allowing the complete rotation also of the second rotor 39, therefore also the first toothed wheel 78 and the second toothed wheel 79, the rotation of which will ultimately actuate the opening mechanism of the lock 1.

It shall be noticed that the lock type can be applied, for example, in a door, shutters, or the like, which would need to have a single side opening by a key (the other one can be opened by the knob described above) or in portable devices which typically have only one keyhole for the key, such as, for example, padlocks.

Finally, it is pointed out that part of the members and/or components of the lock 1 according to the embodiments or examples described above can be made of any suitable material, for example, metal and/or metal alloys, and other ones can be made of plastic materials, resins, and so on.

In addition, in accordance with the present invention, a lock assembly comprises the lock 1, according to any of the embodiments described above, and the actuation key 200 of the lock 1, also described above.

Referring now to the Figs. described above, an operation example of the lock 1 according to a described embodiment is now briefly described.

Upon the insertion of the key 200, the tooth 35 is at the beginning of the coil groove 208 that is present on the side wall 204 of the main body 203 of the key 200, while each thrust member of the plurality of thrust members 203' of the code-holder member 203 is inserted within the respective through opening of said plurality of members of through openings 62 of the first peripheral body 57 of the second rotor 39.

Each cylindrical member of said first plurality of cylindrical members 65, under the action of the respective thrust member, translates along the longitudinal development direction L of the body 2, to abut against a respective cylindrical member of the second plurality of cylindrical members 81.

The translation of each cylindrical member of the second plurality of cylindrical members 81 involves the translation, along the main development direction P, inclined by the determined inclination angle with respect to the longitudinal development direction L of the body 2, of an engaging member of said first plurality of engaging members 85 so that the respective pins face the respective holes of the first plurality of holes 49 and the second plurality of holes of said at least one rib 45 of said plurality of ribs 45 with which the first rotor 37 is provided. In this context, the translation of each cylindrical member of the second plurality of cylindrical members 81 involves the translation, along the longitudinal development direction L of the body 2, of an engaging member of said second plurality of engaging members 91 so that it faces the respective notches of the first plurality of notches 50 and the second plurality of notches 51 of said at least one rib 45 of said plurality of ribs 45 with which the first rotor 37 is provided.

Subsequently, by a first rotation portion of the key 200, the second rotor 39 rotates about the longitudinal development direction L of the body 2 in order to allow the insertion of one of the pins of the engaging member of the first plurality of engaging members 45 in the respective hole of the first plurality of holes 49 and the insertion of the second engaging member of said second plurality of engaging members 91 within the respective notch of the first plurality of notches 50, reaching an engagement position between the first rotor 37 and the second rotor 39, at a code representative of a type of key within a hierarchic key system.

In said engagement position, the first rotor 37 and the second rotor 39, by a second portion of rotation of the key 200, integrally translate along the longitudinal development direction L of the body 2 together with the second component 110 of the locking/unlocking mechanism 100 of the lock 1 so as to disengage the rib N of the second component 110 from the first peripheral stop member 103 of the first component 101. This allows the second component 110 bringing the second rotor 39 to a complete rotation. The complete rotation of the second rotor 39 involves the complete rotation of the first toothed wheel 78, hence of the second toothed wheel 79, the rotation of which ultimately actuates the opening mechanism of the lock 1.

By extracting the key 200, by means of the various springs present within the lock, the second component 110 comes back to an engagement position with the first component 101 of the locking/unlocking mechanism 100 of the lock 1, inhibiting the rotation of the first toothed wheel 78 on the second toothed wheel 79, while the second rotor 39 comes back to a disengagement position with the first rotor 37.

As it can be noticed, the object of the present invention is fully achieved, since the mechanical lock of the invention has a lesser possibility to be break open by the current methods used to break open the locks described with reference to the prior art.

In fact, without the insertion of the right key, the first rotor 37 and the second rotor 39 cannot translate integrally to reach the unlocking of the mechanical actuator.

Furthermore, it is not possible to keep the first rotor 37 and the second rotor 39 in tension in order to obtain the code of the key. In fact, any attempt to rotate the second rotor 39 will result in a possible damage to a part of the second rotor, without the possibility to access and actuate the first rotor 37 to displace the mechanical actuator 100.

Again, it is pointed out that the independent rotation of the first rotor 37 and the second rotor 39 advantageously allows both rotors not to keep a mutual torsional tension, which could be exploited for break opening the lock.

Other advantages of the lock in accordance with the present invention are as follows.

First of all, it is possible to change or create an actuation code of the lock by replacing the first plurality of cylindrical members 65 and/or by changing the position through the adjusting members (screws) of the plurality of ribs 45 and/or replacing the plurality of ribs 45.

Furthermore, again through the adjusting members (screws) it is possible to change the initial position of the plurality of ribs 45 present within the first rotor 37 by selecting as the hierarchic key level of invalidating within a hierarchic key system (user key, master key, or general master key).

Again, still in the context of a hierarchic key system, the first key (user key), the second key (master key), and the third key (general master key) allow positioning the second rotor (internal rotor) and the first and second engaging members transmitting the key code at different points. The key code is applied at different points in the ribs of said plurality of ribs with which the first rotor (external rotor) is provided. Unlike what has been described with reference to the prior art, once the codes of the user key minus one have been inserted, it is not possible to search, with the last code left, the position corresponding to the code of the key of the higher hierarchic level (for example, the master key), since it is located at a different point, and it is not in any case accessible.

In addition, again in the context of a hierarchic key system, the fact that the first code, the second code and the third code respectively corresponding to the first key, the second key and the third key act at different points (first or second plurality of holes and first or second plurality of notches present on at least one rib with which the first rotor is provided), such codes do not mutually interfere at all (they are, inter alia, on three different directrices), therefore they cannot be combines, in fact further increasing the lock security.

In addition, in the case of loss of the key, it is sufficient to change the first plurality of cylindrical members by a simple mechanical operation, without necessarily having to change the whole lock.

Finally, in the lock assembly of the present invention, the actuation key of the lock has an inner cavity suitable to house multiple code-holder members that are easily extractable and mutually interchangeable, to use the same main body with a gripping knob to open multiple locks with different opening codes. Furthermore, such actuation key allows conveniently transporting multiple code-holder members, with reduced overall dimensions, also ensuring the robustness and secrecy of the codes contained therein.

To the above-described embodiments of the mechanical lock, those of ordinary skill in the art, in order to meet contingent needs, will be able to make modifications, adaptations, and replacements of elements with functionally equivalent other ones, without departing from the scope of the following claims. Each of the characteristics described as belonging to a possible embodiment can be implemented independently from the other embodiments described.

The invention claimed is:

1. A lock comprising:

a body suitable to define a housing having a longitudinal development direction along a insertion direction of a key, said housing comprising a first portion and a second portion mutually adjacent along the longitudinal development direction of the body;

a first rotor suitable to be rotationally housed within the first portion of said housing of such body about the longitudinal development direction of the body, said first rotor being suitable to define a further housing;

a second rotor comprising a first portion suitable to be rotationally housed within the second portion of said housing of the body about the longitudinal development direction of such body, said second rotor comprising a second portion suitable to be rotationally housed within the further housing defined by the first rotor about the longitudinal development direction of such body, said second rotor, by the insertion of the key, being suitable to translate along the longitudinal development direction of the body with respect to the first rotor, said second rotor, by a first rotation portion of the key, being suitable to rotate about the longitudinal development direction of the body with respect to the first rotor, to pass from a disengagement position to an engagement position with said first rotor, in said engagement position, said first rotor and said second rotor, by a second portion of rotation of the key, being suitable to integrally translate along the longitudinal development direction of the body to reach an actuating position of the lock.

2. The lock according to claim 1, wherein the first rotor comprises a first peripheral wall having a respective opening and a second peripheral wall, opposite said first peripheral wall, having a respective opening, the first rotor comprising a side wall extending, along the longitudinal development direction of the body, between the first peripheral wall and the second peripheral wall.

3. The lock according to claim 2, wherein the first rotor comprises a plurality of ribs distributed on the inner surface of the side wall, each rib of said plurality of ribs extending along the longitudinal development direction of the body.

4. The lock according to claim 3, wherein each rib of said plurality of ribs comprises a first radial wall and a second radial wall extending radially with respect to the longitudinal development direction of the body, each rib of said plurality of ribs further comprising a connecting wall, opposite the inner surface of the side wall of the first rotor, between the first radial wall and the second radial wall.

5. The lock according to claim 4, wherein the first rotor further comprises a first plurality of holes distributed on the first radial wall of each rib of said plurality of ribs.

6. The lock according to claim 5, wherein the first rotor further comprises a second plurality of holes distributed on the second radial wall of each rib of said plurality of ribs, the second plurality of holes being distributed on the second radial wall so that each hole of the second plurality of holes is aligned with a hole of the first plurality of holes.

7. The lock according to claim 4, wherein the first rotor further comprises a first plurality of notches distributed on the first radial wall of at least one rib of said plurality of ribs.

8. The lock according to claim 7, wherein the first rotor further comprises a second plurality of notches distributed on the second radial wall of at least one further rib of said plurality of ribs, each notch of the above-mentioned second plurality of notches being aligned with a notch of the first plurality of notches.

9. The lock according to claim 8, wherein the second rotor comprises a first plurality of cylindrical members, each of which being housed within a through opening of a first plurality of through openings extending parallel to the longitudinal development direction of the body, each cylindrical member of said first plurality of cylindrical members being suitable to slide parallel to the longitudinal development direction of the body from a rest position to an operative position within the respective through opening of said first plurality of through openings under the action of a respective thrust member insertable in the through opening according to the insertion direction of the key.

10. The lock according to claim 9, wherein the second rotor comprises a connecting body between a first peripheral body and an intermediate body, the connecting body further comprising a second plurality of through openings extending parallel to the longitudinal development direction of the body, the second plurality of through openings being aligned with the first plurality of through openings of the first peripheral body, the intermediate body further comprising a third plurality of through openings extending parallel to the longitudinal development direction of the body within a first peripheral portion and a central portion of the intermediate body, the third plurality of through openings being aligned with the second plurality of through openings of the connecting body.

11. The lock according to claim 10, wherein the second rotor comprises a second plurality of cylindrical members, each of which being housed within a through opening defined by a through opening of said third plurality of through openings aligned with a respective through opening of the second plurality of through openings, each cylindrical member of said second plurality of cylindrical members being suitable to slide, parallel to the longitudinal development direction of the body, from a rest position to an operative position within the respective through opening under the action of a respective cylindrical member of said first plurality of cylindrical members.

12. Lock according to claim 10, wherein the intermediate body of the second rotor comprises a first peripheral portion, a second peripheral portion and a central portion interposed between said first peripheral portion and said second peripheral portion, the second peripheral portion comprising a peripheral wall, facing the support body of engaging members between the first rotor and the second rotor, and a connecting wall interposed between the central portion and the peripheral wall, the connecting wall, along the longitudinal development direction of the body, having a cylindrical cross-section gradually increasing starting from the central portion up to the peripheral wall, so as to define an outer profile of the connecting wall inclined, with respect to the longitudinal development direction of the body, by a determined inclination angle.

13. The lock according to claim 12, wherein the support body of engaging members comprises a first outer portion and a second inner portion, the second inner portion being suitable to be housed within a further housing defined in the connecting wall of the second peripheral portion of the intermediate body, the second inner portion, along the longitudinal development direction of the body having a frusto-conical section the outer surface of which is inclined, with respect to the longitudinal development direction of the body, by a determined inclination angle.

14. The lock according to claim 13, wherein the first outer portion of the support body of engaging members further comprises a plurality of support guides, each support guide of said plurality extending, along an inclined direction with respect to the longitudinal development direction of the body by the determined inclination angle, from the second inner portion to the outer surface of the first outer portion, each support guide of said plurality being distributed in the first outer portion so as to be substantially aligned with a respective through opening of said third plurality of through openings.

15. The lock according to claim 14, wherein the second rotor further comprises a first plurality of engaging members of said second rotor with said first rotor, each being slidably housable within a respective support guide of the above-mentioned plurality, each engaging member comprising a first end and a second end, opposite said first end, each engaging member, at the second end, being provided with a first pin and of a second pin extending orthogonally to a main development direction of a main body of the engaging member.

16. The lock according to claim 15, wherein the first pin is suitable to engage with any holes of the first plurality of holes distributed on the first radial wall of said at least one rib of said plurality of ribs of the first rotor, the second pin being suitable to engage with any holes of the second plurality of holes distributed on the second radial wall of said at least one further rib of said plurality of ribs, adjacent to said at least one rib.

17. The lock according to claim 1, further comprising a mechanical actuator, said mechanical actuator further comprising a first component rotationally housed within the first portion of the housing of the body, said first component being suitable to translate, along the longitudinal development direction of the body, the first component comprising a first peripheral stop member and a second peripheral member, the first peripheral stop member comprising a first peripheral wall and a second inner wall suitable to define a radial opening.

18. The lock according to claim 17, wherein the mechanical actuator further comprises a second component that can be housed within the first portion of the housing of the body, the second component being operatively connected with the first rotor to translate, integrally with the first rotor, along the longitudinal development direction of the body.

19. The lock according to claim 18, wherein the second component comprises a rib extending parallel to the longitudinal development direction of the body, defined on the inner surface of the peripheral wall, of the central wall and of the second peripheral wall, said rib being suitable to slide along the longitudinal development direction of the body within at least two ribs defined on the outer surface of an inner wall of the first portion of the body, said rib being suitable to slide with respect to the second inner wall of the first peripheral stop member to bring the second component of the mechanical actuator from a locking position to an unlocking position with respect to the first component.

20. The lock according to claim 19, wherein the mechanical actuator further comprises a knob comprising a longitudinal portion suitable to be connected with the second peripheral member of the first component, said knob being suitable to bring the first component of the mechanical actuator from the locking position to the unlocking position with respect to the second component.

21. Lock assembly comprising a lock in accordance with claim 1, and an actuation key of said lock, said key comprising a main body, a gripping knob and at least one code-holder member, said main body, having a longitudinal development direction, comprising a side wall, a first base and a second base, opposite said first base, the second base being a bottom wall of a cavity present within the main body starting from a respective opening obtained on the first base.

22. The lock assembly according to claim 21, wherein the code-holder member comprises a plurality of thrust members extending from a cylindrical base along the longitudinal development direction of the main body, each thrust member being suitable to be inserted within a through opening of a first plurality of through openings that is present in a first peripheral portion of the second rotor to abut against and translate along longitudinal development direction of the body together with a respective cylindrical member of a first plurality of cylindrical members of the second rotor, each of which being housed within a through opening of the first plurality of through openings extending parallel to the longitudinal development direction of the body, each cylindrical member of said first plurality of cylindrical members being suitable to slide parallel to the longitudinal development direction of the body from a rest position to an operative position within the respective through opening of said first plurality of through openings under the action of a respective thrust member insertable in the through opening according to the insertion direction of the key.

23. The lock assembly according to claim 21, wherein the main body comprises a coil groove obtained on the side wall starting from the first base, said coil groove being suitable to engage with a tooth defined on a surface of a frusto-conical section obtained at a first opening of an inner wall of a first end of the body of the lock.

* * * * *